US006533561B1

(12) United States Patent
Furusho et al.

(10) Patent No.: US 6,533,561 B1
(45) Date of Patent: Mar. 18, 2003

(54) SCROLL TYPE COMPRESSOR

(75) Inventors: Kazuhiro Furusho, Osaka (JP); Masahide Higuchi, Osaka (JP); Katsumi Kato, Osaka (JP); Keiji Komori, Osaka (JP); Hiroshi Kitaura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/889,796

(22) PCT Filed: Nov. 20, 2000

(86) PCT No.: PCT/JP00/08157

§ 371 (c)(1),
(2), (4) Date: Jul. 20, 2001

(87) PCT Pub. No.: WO01/38740

PCT Pub. Date: May 31, 2001

(30) Foreign Application Priority Data

Nov. 22, 1999 (JP) ..... 11-331946
Mar. 28, 2000 (JP) ..... 2000-088041

(51) Int. Cl.[7] ..... F04C 18/00
(52) U.S. Cl. ..... 418/55.5; 418/57; 418/56; 418/55.4
(58) Field of Search ..... 418/55.6, 55.5, 418/57, 55.4

(56) References Cited

U.S. PATENT DOCUMENTS

| | | | | |
|---|---|---|---|---|
| 4,522,575 A | | 6/1985 | Tischer et al. | |
| 4,645,437 A | | 2/1987 | Hayano et al. | |
| 4,669,962 A | * | 6/1987 | Mizuno et al. | 418/55.5 |
| 5,622,488 A | | 4/1997 | Ueda et al. | |
| 5,678,986 A | * | 10/1997 | Terauchi et al. | 418/55.6 |

FOREIGN PATENT DOCUMENTS

| | | | | |
|---|---|---|---|---|
| DE | 196 42 798 A | | 11/1997 | |
| EP | 0 898 079 | | 2/1999 | |
| JP | 58214691 A | * | 12/1983 | F04C/18/02 |
| JP | 60-249685 | | 12/1985 | |
| JP | 61192881 A | * | 8/1986 | F04C/18/02 |
| JP | 62-178789 | | 8/1987 | |
| JP | 05180181 A | * | 7/1993 | F04C/18/02 |
| JP | 05312156 A | | 11/1993 | |
| JP | 5-340363 | | 12/1993 | |
| JP | 08021382 A | * | 1/1996 | F04C/18/02 |
| JP | 08061255 A | * | 3/1996 | F04C/18/02 |
| JP | 8-303371 | | 11/1996 | |
| JP | 09-217690 | | 8/1997 | |
| JP | 11-173283 | | 6/1999 | |
| JP | 11-182479 | | 7/1999 | |

OTHER PUBLICATIONS

Australian Search Report and Written Opinion mailed May 2, 2002 from corresponding Singapore Patent Application No. SG 200104384–3 filed Nov. 20, 2000.

* cited by examiner

*Primary Examiner*—Thomas Denion
*Assistant Examiner*—Theresa Trieu
(74) *Attorney, Agent, or Firm*—Nixon Peabody LLP; Donald R. Studebaker

(57) ABSTRACT

In a scroll type compressor (1) that includes a fixed scroll (21) fixed inside of a casing (10) and a movable scroll (22) meshed with the fixed scroll (21) and presses the movable scroll (22) against the fixed scroll (21), the pressing force of the movable scroll (22) against the fixed scroll (21) is obtained from the pressure of a high-pressure space (S2) that acts on the back face of the movable scroll (22) and the pressing force is controlled in accordance with the variation in the compression ratio with the change in the operating condition thereby preventing decrease in efficiency and mechanical loss.

16 Claims, 15 Drawing Sheets

PRIOR ART

PRIOR ART

PRIOR ART

PRIOR ART

SCROLL TYPE COMPRESSOR

TECHNICAL FIELD

This invention relates to a scroll type compressor, and particularly relates to measures against reduction of its operating efficiency.

BACKGROUND ART

As compressors for compressing refrigerant in a refrigeration cycle, there have been conventionally used scroll type compressors disclosed for example in Japanese Unexamined Patent Publication No. 5-312156. The scroll type compressor is provided in its casing with a fixed scroll and a movable scroll which have respective volute laps meshed with each other. The fixed scroll is fixed to the casing, and the movable scroll is coupled to an offset shaft portion of a drive shaft. Further, the scroll type compressor is arranged so that the movable scroll does not rotates on the axis of the fixed scroll but travels bodily around the fixed scroll to contract a compression space defined between both the laps thereby compressing refrigerant.

Meanwhile, as shown in FIG. 14, compressing the refrigerant causes the movable scroll (OS) to experience a thrust load PS as an axial force and a radial load PT as a lateral force. Therefore, in an arrangement wherein a high-pressure section (P) is provided for making a high refrigerant pressure PA act on the back face (bottom face) of the movable scroll (OS) to press the movable scroll (OS) against the fixed scroll (FS) with a force counteracting the axial force PS, if the pressing force is small and a vector as the resultant of forces acting on the movable scroll (OS) passes outside of the outer periphery of a thrust bearing, the movable scroll (OS) will be inclined (upset) as being shown in FIG. 15 by the action of so-called upsetting moment M. This induces leakage of the refrigerant, resulting in decreased efficiency. On the other hand, in the arrangement wherein the movable scroll (OS) is pressed against the fixed scroll (FS) with the force counteracting the axial force PS as shown in FIG. 14, if the pressing force is contrariwise large (and a vector as the resultant of forces acting on the movable scroll (OS) passes inside of the outer periphery of the thrust bearing), it will be possible to prevent the movable scroll (OS) from upsetting.

In the meantime, the scroll type compressor has a constant volume ratio. Therefore, as shown in FIG. 16, even if the operating conditions change so that a high pressure or a low pressure varies to change the compression ratio, the axial force PS and the lateral force PT do not largely change. In contrast, the pressing force from the above-mentioned refrigerant pressure (referred to as a back pressure in the figure) on the back face of the movable scroll (OS) changes to a large extent with the change in the compression ratio.

Here, if the area of the high-pressure section (P) which makes a high pressure act on the movable scroll (OS) is set so as not to upset the movable scroll (OS) under conditions of high compression ratios as shown in FIG. 17A, the movable scroll (OS) will be easily upset under conditions of low compression ratios because of lack of the pressing force, for example, due to a reduced high pressure.

On the other hand, if the area of the high-pressure section (P) is set in conformity with the conditions of low compression ratios, a high compression ratio induced for example by an increase in the high pressure will cause the pressing force of the movable scroll (OS) against the fixed scroll (FS) to be excessive relative to a minimum pressing force determined by the axial force PS and the lateral force PT as shown in FIG. 17B. As a result, a significant thrust force upward when viewed in FIG. 14 acts on the movable scroll (OS) so that mechanical loss will be increased to reduce the efficiency.

The above is substantially the case for the variation in the low pressure (which usually varies together with the high pressure). Accordingly, generally speaking, in scroll compressors of the type which uses a refrigerant pressure or the like to press the movable scroll (OS) against the fixed scroll (FS), upset of the movable scroll tends to easily occur at lower compression ratios with reference to a compression ratio substantially specific for each compressor while the pressing force tends to easily become excessive at higher compression ratios.

The present invention has been devised in view of such problems, and an object thereof is to prevent decrease in efficiency by controlling the pressing force of the movable scroll against the fixed scroll.

DISCLOSURE OF INVENTION

The present invention provides for controlling a pressing force of a movable scroll (22) against a fixed scroll (21) depending upon operating conditions in a manner to change the pressing force in accordance with the variation in the compression ratio.

Specifically, a solution taken in the present invention is predicated upon a scroll type compressor including: a fixed scroll (21) fixed inside of a casing (10); a movable scroll (22) meshed with the fixed scroll (21); and pressing means (40) for pressing the movable scroll (22) against the fixed scroll (21). Further, the pressing means (40) is arranged to control a pressing force of the movable scroll (22) against the fixed scroll (21) in accordance with variation in compression ratio. Thus, the pressing force can be suppressed at high compression ratios while the suppression can be relieved at low compression ratios, thereby providing control of the pressing force depending upon operating conditions. It is to be noted that the manner to control the pressing force in accordance with the variation in the compression ratio can include using, for example, a pressure differential between high and low pressures or the high pressure (a discharge pressure).

In the above construction, for example, the pressing means (40) can be arranged to have a high-pressure space (S2) that serves a back face side of the movable scroll (22) and to suppress the pressing force of the movable scroll (22) against the fixed scroll (21) when the compression ratio exceeds a predetermined value (i.e., when the movable scroll (22) comes into a condition to be pressed with a sufficient force against the fixed scroll (21)). It is to be noted that, in this case, as the working condition that "the compression ratio exceeds a predetermined value", use can be made of approximate conditions such as whether the pressure differential between high and low pressures has reached a preset given value (this is also the case for the following respective arrangements).

Further, in the above arrangement, the pressing means (40) can have a structure that includes an oil groove (43) formed between contact surfaces of the fixed scroll (21) and the movable scroll (22) in contact with each other and high-pressure oil introducing means (46) for introducing a high-pressure oil into the oil groove (43) when the compression ratio exceeds the predetermined value.

Furthermore, in the above arrangement, the highpressure space (S2) is preferably a high-pressure oil working space into which the high-pressure oil is supplied, and the high-pressure oil introducing means (46) is preferably arranged to guide the high-pressure oil in the high-pressure oil working space (S2) into the oil groove (43) when the compression ratio exceeds the predetermined value.

Moreover, in the above arrangement, the high-pressure oil introducing means (46) preferably has a structure that includes a high-pressure oil introduction passage (44) communicating from the high-pressure oil working space (S2) to the oil groove (43) and a high-pressure oil introduction valve (45) for opening/closing the high-pressure oil introduction passage (44).

Further, in the above arrangement, the high-pressure oil introduction valve (45) is preferably arranged to open the high-pressure oil introduction passage (44) upon excess of the compression ratio over the predetermined value while closing the high-pressure oil introduction passage (44) at the compression ratio equal to or less than the predetermined value.

Furthermore, in the above arrangement, the high-pressure oil introduction valve (45) can have a structure that includes a cylinder (47) disposed to traverse the way of the high-pressure oil introduction passage (44) and a piston-like valve body (48) provided for reciprocation movement in the cylinder (47), and the valve body (48) can be arranged to move to an open position at which the high-pressure oil introduction passage (44) is opened upon excess of the compression ratio over the predetermined value while moving to a closed position at which the high-pressure oil introduction passage (44) is closed at the compression ratio equal to or less than the predetermined value.

Moreover, in the above arrangement, the cylinder (47) of the high-pressure oil introduction valve (45) can have a structure that communicates at one end thereof with a low-pressure space (S1) provided in the casing (10) and communicates at the other end with a high-pressure space (S3) in the casing (10), urging means (50) can be provided for urging the valve body (48) toward the closed position in the cylinder (47), and an urging force of the urging means (50) can be set in accordance with a predetermined pressure differential between the low-pressure space (S1) and the high-pressure space (S3) so that the urging means (50) holds the valve body (48) at the closed position when the compression ratio is equal to or less than the predetermined value and allows movement of the valve body (48) to the open position when the compression ratio exceeds the predetermined value.

Further, in the above arrangement, the valve body (48) can have a structure that includes a communication passage (48*a*) to block the high-pressure oil introduction passage (44) at its closed position while opening the high-pressure oil introduction passage (44) through the communication passage (48*a*) at its open position.

In this structure, the communication passage (48*a*) of the valve body (48) is preferably constituted by a circumferential channel formed in an outer peripheral surface of the valve body (48).

Further, in the above arrangement, a frame (23) for separating the low-pressure space (S1) and the high-pressure space (S3) can be disposed in the casing (10) below the movable scroll (22), a sealing member (42) can be provided for dividing a space located between the frame (23) and the movable scroll (22) into the low-pressure space (S1) and the high-pressure oil working space (S2), and the frame (23) can be provided with the high-pressure oil introduction passage (44) and the high-pressure oil introduction valve (45).

Further, another solution taken in the present invention is also predicated upon the above-mentioned scroll type compressor including: a fixed scroll (21) fixed inside of a casing (10); a movable scroll (22) meshed with the fixed scroll (21); and pressing means (40) for pressing the movable scroll (22) against the fixed scroll (21). Further, the pressing means (40) can also be arranged to have a high-pressure space (S2) that serves a back face side of the movable scroll (22) and to always suppress a pressing force of the movable scroll (22) against the fixed scroll (21) through the high-pressure space (S2) in association with variation in compression ratio. More specifically, it will be preferable to suppress the pressing force to a large extent at high compression ratios while suppressing it to a small extent at low compression ratios.

In this construction, the pressing means (40) can have a structure that includes an oil groove (43) formed between contact surfaces of the fixed scroll (21) and the movable scroll (22) in contact with each other and a high-pressure oil introduction passage (44) for always introducing a high-pressure oil in the casing (10) into the oil groove (43).

Further, in this arrangement, the high-pressure space (S2) can be a high-pressure oil working space into which the high-pressure oil is supplied, and the high-pressure oil introduction passage (44) can be arranged to communicate from the high-pressure oil working space (S2) to the oil groove (43) and always guide the high-pressure oil in the high-pressure oil working space (S2) to the oil groove (43).

Furthermore, in the above arrangement, a frame (23) for dividing an inner space of the casing (10) into a low-pressure space (S1) and a high-pressure space (S3) can be disposed below the movable scroll (22), a sealing member (42) can be provided for dividing a space between the frame (23) and the movable scroll (22) into the low-pressure space (S1) and the high-pressure oil working space (S2), and the frame (23) can be provided with the high-pressure oil introduction passage (44).

Moreover, in each of the above arrangements, the high-pressure oil introduction passage (44) is preferably provided with a restriction section (44*b*).

Further, the restriction section (44*b*) can be constituted by a reduced-diameter part provided at least partially in the high-pressure oil introduction passage (44), constituted by a capillary tube (44*e*) provided at least partially in the high-pressure oil introduction passage (44), or formed so that a bar-like member (44*f*) narrower in diameter than the high-pressure oil introduction passage (44) is placed at least partially in the high-pressure oil introduction passage (44) to form a clearance with the high-pressure oil introduction passage (44).

(Operations)

In the above solutions, since the pressing force of the movable scroll (22) against the fixed scroll (21) is controlled in accordance with the variation in the compression ratio, the pressing force can be changed depending upon operating conditions.

Particularly in the arrangement wherein the pressing force of the movable scroll is suppressed when the compression ratio exceeds its predetermined value (approximately, for example, when the pressure differential between high and low pressures exceeds its predetermined value), if setting is made such that an appropriate pressing force can be obtained in the conditions where the compression ratio is equal to or less than the predetermined value, the movable scroll (22) can be held against upsetting by counteracting the gas compression-induced thrust load acting on the movable scroll (22) with the pressing force of the high-pressure space (S2) until the compression ratio (or any approximation such as the pressure differential between high and low pressures:

same is true hereinafter) has reached the predetermined value. Further, when the compression ratio exceeds the predetermined value, suppressing the pressing force of the movable scroll (22) against the fixed scroll (21) can restrain the mechanical loss from increasing due to the excess of the pressing force.

Further, if the compressor is arranged to include an oil groove (43) between contact surfaces of the fixed scroll (21) and the movable scroll (22) in contact with each other and to introduce a high-pressure oil into the oil groove (43) when the compression ratio exceeds the predetermined value, the high-pressure oil provides a force acting in a direction to separate the movable scroll (22) away from the fixed scroll (21) so that the pressing force of the movable scroll (22) can be suppressed.

Furthermore, if the compressor is arranged to form the high-pressure space by a high-pressure oil working space (S2) and to guide the high-pressure oil in the high-pressure oil working space (S2) into the oil groove (43) when the compression ratio exceeds the predetermined value, at low compression ratios the pressure of the high-pressure oil presses the movable scroll (22) against the fixed scroll (21) to hold the movable scroll (22) against upsetting, while, upon excess of the compression ratio over the predetermined value, the pressure of the high-pressure oil is used to develop a force in a direction to separate the movable scroll (22) away from the fixed scroll (21) to restrain overpressing.

Moreover, if the high-pressure oil introduction passage (44) and the high-pressure oil introduction valve (45) for opening/closing the high-pressure oil introduction passage (44) are used as the high-pressure oil introducing means (46) for guiding the high-pressure oil into the oil groove (43), the high-pressure oil introduction valve (45) opens the high-pressure oil introduction passage (44) upon excess of the compression ratio over the predetermined value while closing it at the compression ratio equal to or less than the predetermined value. Thus, upset of the movable scroll (22) at low compression ratios and over-pressing thereof at high compression ratios can be prevented.

Further, the high-pressure oil introduction valve (45) has a structure that includes a cylinder (47) disposed to traverse the way of the high-pressure oil introduction passage (44) and a valve body (48) provided for reciprocation movement in the cylinder (47). In this manner, when the compression ratio exceeds the predetermined value, the valve body (48) is moved to its open position to open the high-pressure oil introduction passage (44) thereby preventing over-pressing of the movable scroll at high compression ratios. On the other hand, when the compression ratio is equal to or less than the predetermined value, the valve body (48) is moved to its closed position to block the high-pressure oil introduction passage (44) thereby preventing upset of the movable scroll (22) at low compression ratios.

Furthermore, if the cylinder (47) of the high-pressure oil introduction valve (45) has a structure that communicates at one end thereof with a low-pressure space (S1) provided in the casing (10) and communicates at the other end with a high-pressure space (S3) in the casing (10) and the valve body (48) is urged toward its closed position in the cylinder (47), when the compression ratio is equal to or less than the predetermined value so that the pressure differential between the low-pressure space (S1) and the high-pressure space (S3) is small, the urging force holds the valve body (48) at its closed position to prevent upset of the movable scroll (22). On the other hand, when the compression ratio exceeds the predetermined value so that the pressure differential is increased over a set point, the pressure differential moves the valve body (48) to the open position against the urging force to prevent over-pressing of the movable scroll (22).

Moreover, if the valve body (48) is formed at its outer periphery with a communication passage **(48*a*) such as a circumferential channel and is arranged to block the high-pressure oil introduction passage (44) at its closed position while opening the high-pressure oil introduction passage (44) through the communication passage (48*a*) at its open position, when the valve body (48) is at its open position, the high-pressure oil introduction passage (44) can be opened through the communication passage (48*a*) to work the high-pressure oil in the oil groove (43) between the fixed scroll (21) and the movable scroll (22) thereby preventing over-pressing of the movable scroll (22)**.

Further, in the arrangement wherein the pressing force of the movable scroll is always suppressed in association with the variation in the compression ratio in the scroll compressor of the above predicated construction, if for example a high-pressure oil introduction passage (44) is provided for always introducing a high-pressure oil in the casing (10) into an oil groove (43) formed between contact surfaces of the fixed scroll (21) and the movable scroll (22) in contact with each other, the pressing force of the movable scroll (22) against the fixed scroll (21) is controlled in a manner for the high-pressure oil to always act on the oil groove (43).

In detail, when for example the high pressure rises so that the compression ratio becomes large, an oil with a higher pressure as compared with the case where the compression ratio is small acts on the oil groove (43). On the other hand, when for example the high pressure drops so that the compression ratio becomes small, an oil with a smaller pressure as compared with the case where the compression ratio is large acts on the oil groove (43). Therefore, the pressing force of the movable scroll (22) against the fixed scroll (21) is always controlled by using the high pressure (discharge pressure) that changes with the variation in the compression ratio. Accordingly, the pressing force is sufficiently suppressed at high compression ratios while the suppression is relieved at low compression ratios. This is substantially true for the consideration of the generic case including the variation in the low pressure. In this manner, the pressing force of the movable scroll (22) against the fixed scroll (21) is controlled in accordance with the variation in the compression ratio (pressure conditions) and thereby changes depending upon the operating conditions.

It is to be noted that if the compressor is set so that an appropriate counter-pressing force (a force in a direction to separate the movable scroll (22) away from the fixed scroll (21)) can be obtained, for example, in the conditions of low compression ratios, it can be supposed that when the compression ratio becomes high, the counter-pressing force will fail to some extent depending upon preset conditions such as the areas of the high-pressure space (S2) and the oil groove (43). In this case, since a counter-pressing effect itself is inevitably developed, the actual pressing force of the movable scroll (22) against the fixed scroll (21) can be suppressed with reliability as compared with the case where the high-pressure oil introduction passage (44) is not provided.

On the contrary, if the compressor is set so that an appropriate counter-pressing force can be obtained, for example, in the conditions of high compression ratios, it can be supposed that when the compression ratio becomes low, the counter-pressing force will be greater than required depending upon conditions so that the movable scroll (22) can be upset. In this case, however, if the restriction section **(44*b*) for dimensionally controlling the clearance of the high-pressure oil introduction passage (44) by the reduced-diameter part (44***b*), the capillary tube (44*e*), the bar-like member (44*f*) or the like is provided, a pressure reduction effect is produced on an oil flowing through the high-pressure oil introduction passage (44) so that the counter-pressing force acting on the movable scroll (22) through the oil groove (43) can be reduced. As a result, even if the movable scroll (22) upsets, it can be recovered to its original un-upset position.

Further, if the high-pressure oil introduction passage (44) is provided with the restriction section (44*b*), it can be restrained so that the oil flows into the oil groove (43) upon upset of the movable scroll (22), thereby restricting oil leakage. As a result, there can be restrained the occurrence of a phenomenon of a decreased oil level resulting from oil inflow into the compression space (24) between both the scrolls (21, 22) and finally the occurrence of a phenomenon of oil shortage.

As can be seen from the above, in terms of practicality, oil leakage and decrease in operating efficiency due to upset of the movable scroll (22) can be suppressed to an extent that provides substantially no problem and leakage of refrigerant from the compression space (24) can be suppressed to the minimum.

Now, supposed that in the case where the high-pressure oil introduction passage (44) is provided with the high-pressure oil introduction valve (45) only without the restriction section (44*b*) and the high-pressure oil introduction valve (45) is actuated with the preset pressure differential between high and low pressures for the purpose of suppressing the pressing force of the movable scroll (22) against the fixed scroll (21) when the compression ratio exceeds the predetermined value, the high-pressure oil introduction valve (45) is set so as not to be actuated in the entire region (A2) including a slight margin beyond a region (A1) in which the upset can occur in FIG. 12 (an operating range diagram wherein the ordinate represents the high pressure and the abscissa represents the low pressure) which shows a working range of the scroll type compressor.

In this case, the inclination of a boundary line (a) of the upset region (A2) depends substantially upon the compression ratio (more specifically, also including the rotating speed or the like as conditions), while the inclination of a boundary line (b) for the working pressure of the high-pressure introduction valve (45) is based upon the pressure differential between high and low pressures. Therefore, both the inclinations of the boundary line (a) and boundary line (b) are normally unequal to each other. An over-pressing region (B2) in which the movable scroll (22) is not counter pressed will be thereby created to some extent in a region (B1) in which no upset originally occurs (in fact, a region also including (A2-A1)).

On the contrary, if the working pressure (see (b)) of the high-pressure oil introduction valve (45) is lowered as shown in FIG. 13, the over-pressing region (B2) can be reduced. At the time, there may occur an over-counter-pressing region (A3) by counter-pressing the movable scroll (22) within the upset region (A2) of the movable scroll (22). In this case, with the provision of the restriction section (44*b*) in the high-pressure oil introduction passage (44), even if the upset occurs in the over-counter-pressing region (A3), the high-pressure oil flowing through the high-pressure oil introduction passage (44) is reduced in pressure in the restriction section (44*b*) to decrease the counter-pressing force. Therefore, the upset can be immediately avoided.

Further, upon upset of the movable scroll (22), the restriction section (44*b*) of the high-pressure oil introduction passage (44) restrains oil inflow into the oil groove (43) and therefore oil leakage can be restricted. Accordingly, the occurrence of phenomena such as oil inflow into the compression space (24), drop in oil level and oil shortage can be suppressed. As can be understood from above, oil leakage and decrease in operating efficiency can be suppressed to an extent that provides substantially no problem in terms of practicality.

If the inclination of the boundary line (a) of the upset region (A2) and the inclination of the boundary line (b) for the working pressure of the high-pressure oil introduction valve (45) are set to substantially match each other both generally based on the compression ratio, the over-pressing region (B2) and the over-counter-pressing region (A3) themselves do not occur, which ensures further stable operation. Specifically, this is true for such a case that the high pressure and low pressure are detected, the compression ratio therebetween is operated and the highpressure oil introduction valve (45) is actuated in accordance with the compression ratio to control the pressing force of the movable scroll (22).

(Effects)

As can be seen from the above, according to the above solutions, the pressing force of the movable scroll (22) against the fixed scroll (21) is controlled in accordance with the variation in the compression ratio thereby changing depending upon operating conditions.

In particular, if a gas compression-induced thrust load acting on the movable scroll (22) is counteracted by a pressing force slightly larger than required for anti-upsetting until the compression ratio (approximately, the pressure differential between high and low pressures: same is true hereinafter) has reached the predetermined value, the movable scroll (22) can be prevented from upsetting. Further, if the high pressure or the like is used to suppress the pressing force of the movable scroll (22) against the fixed scroll (21) when the compression ratio exceeds the predetermined value, it can be prevented that the pressing force becomes excessive to increase the mechanical loss.

As described above, according to the above construction, it can be prevented that at low compression ratios the pressing force fails so that the movable scroll (22) upsets and refrigerant leaks resulting in decreased efficiency, and at the same time it can be prevented that at high compression ratios the pressing force becomes excessive to produce an excessive mechanical loss. Therefore, efficient operation can be performed over the entire range from low compression ratio to high compression ratio.

Further, if the compressor is arranged so that an oil groove (43) is provided between contact surfaces of the fixed scroll (21) and the movable scroll (22) in contact with each other and a high-pressure oil is introduced into the oil groove (43), when the compression ratio exceeds the predetermined value, the high pressure in the compressor (1) is used to provide a force acting in a direction to separate the movable scroll (22) away from the fixed scroll (21). Accordingly, the pressure in the compressor (1) can be effectively used to prevent decrease in efficiency.

In particular, if the compressor is arranged so that the high-pressure space is a high-pressure oil working space (S2) and the high-pressure oil in the high-pressure oil working space (S2) is guided into the oil groove (43) when the compression ratio exceeds the predetermined value, the pressure of the high-pressure oil that was used to press the movable scroll (22) against the fixed scroll (21) until the compression ratio has exceeded the predetermined value can be used to develop a force in a direction to separate the movable scroll (22) away from the fixed scroll (21) upon excess of the compression ratio over the predetermined value. Accordingly, the pressure in the compressor (1) can be used more effectively.

Further, if the high-pressure oil introduction passage (44) and the high-pressure oil introduction valve (45) for opening/closing the high-pressure oil introduction passage (44) are used as the high-pressure oil introducing means (46) for guiding the high-pressure oil into the oil groove (43), and the high-pressure oil introduction valve (45) opens the high-pressure oil introduction passage (44) upon excess of the compression ratio over the predetermined value while closing it at the compression ratio equal to or less than the predetermined value, upset of the movable scroll at low compression ratios and over-pressing thereof at high compression ratios can be prevented and the construction can be prevented from being complicated.

In particular, if the high-pressure oil introduction valve (45) has a structure that includes a cylinder (47) disposed to traverse the way of the high-pressure oil introduction passage (44) and a valve body (48) provided for reciprocation movement in the cylinder (47) and the valve body (48) is allowed to move to its open or closed position in accordance with the compression ratio, the arrangement wherein the high-pressure oil introduction passage (44) is opened/closed to prevent over-pressing of the movable scroll (22) at high compression ratios and upset of the movable scroll (22) at low compression ratios can be concretely and easily implemented.

In this case, if the cylinder (47) is arranged to communicate at one end thereof with a low-pressure space (S1) in the casing (10) and communicate at the other end with a high-pressure space (S3) in the casing (10) and the valve body (48) is urged toward the closed position in the cylinder (47), when the urging force and the pressure differential with which the high-pressure oil introduction valve (45) is actuated are set at respective suitable values, movement of the valve body (48) in accordance with the variation in the compression ratio can be ensured in a simple structure.

Further, if the valve body (48) is formed in its outer periphery with a communication passage (48*a*) such as a circumferential channel and is arranged to open/close the high-pressure oil introduction passage (44) using the communication passage (48*a*), the construction can be further simplified.

Furthermore, the compressor has a structure in which a frame (23) for dividing an inner space of the casing (10) into a low-pressure space (S1) and a high-pressure space (S3) is disposed below the movable scroll (22), a sealing member (42) is provided for dividing a space located between the frame (23) and the movable scroll (22) into the low-pressure space (S1) and a high-pressure oil working space (S2), and the frame (23) is provided with the high-pressure oil introduction passage (44) and the high-pressure oil introduction valve (45). In this case, the arrangement wherein the high-pressure oil introduction valve (45) is actuated with the pressure differential between high and low pressures in accordance with the variation in the compression ratio can be easily implemented.

Moreover, in the arrangement wherein the pressing force of the movable scroll is always suppressed by the pressing means (40) in association with the variation in the compression ratio, when for example a high-pressure oil introduction passage (44) is provided for always introducing the high-pressure oil in the casing (10), as mentioned above, into the oil groove (43) formed between contact surfaces of the fixed scroll (21) and the movable scroll (22) in contact with each other, the pressing force of the movable scroll (22) against the fixed scroll (21) can be suppressed at high compression ratios while the suppression can be relieved at low compression ratios. In this manner, since the pressing force of the movable scroll (22) against the fixed scroll (21) is controlled in accordance with the variation in the compression ratio with the change in the operating condition, the compressor can be operated over the entire range from low compression ratio to high compression ratio with higher efficiency than the prior art.

Further, even if the counter-pressing force fails to some extent at high compression ratios, a counter-pressing effect itself is inevitably developed. Therefore, the pressing force of the movable scroll (22) against the fixed scroll (21) can be suppressed at high compression ratios with higher reliability than the prior art thereby providing increased efficiency.

On the contrary, when the compressor has a structure that includes a restriction section (44*b*) in the high-pressure oil introduction passage (44), even if the movable scroll (22) is upset in the conditions of low compression ratios, the high-pressure oil is reduced in pressure and the suppression of the pressing force is relieved so that the movable scroll (22) can be recovered from the upset position and leakage of oil and refrigerant can be suppressed. Accordingly, there seldom arises a problem of deterioration in efficiency in practice, which enables the operation to be stabled.

Further, if both the high-pressure oil introduction valve (45) and the restriction section (44*b*) for reducing the pressure of the high-pressure oil are provided in the high-pressure oil introduction passage (44), oil inflow into the compression space (24), drop in oil level and oil shortage can be suppressed even if the upset occurs in the over-counter-pressing region (A3). And, upon upset of the movable scroll (22), the high-pressure oil flowing through the high-pressure oil introduction passage (44) is reduced in pressure in the restriction section (44*b*) and then guided into the oil groove (43). Therefore, the counter-pressing force is decreased so that the movable scroll is immediately recovered from the upset position. Furthermore, since the over-pressing region (B2) can be reduced, this provides further stable operation over the entire range from low compression ratio to high compression ratio.

When the arrangement wherein the high-pressure oil introduction valve (45) is provided uses the pressure differential between high and low pressures to actuate the valve, it is difficult to control the pressing force in complete accordance with the variation in the compression ratio. However, depending upon conditions such as setting of the working pressure of the valve, the pressing force can be controlled substantially in accordance with the variation in the compression ratio.

Further, the description mentioned so far has been made with reference to the variation in the compression ratio with the variation in the high pressure. Substantially the same operations and effects can also be exhibited for consideration of the generic case including the variation in the low pressure.

BEST MODE FOR CARRYING OUT THE INVENTION (First Embodiment)

Hereinafter, a first embodiment of the present invention will be described in detail with reference to the drawings.

Figure 1:
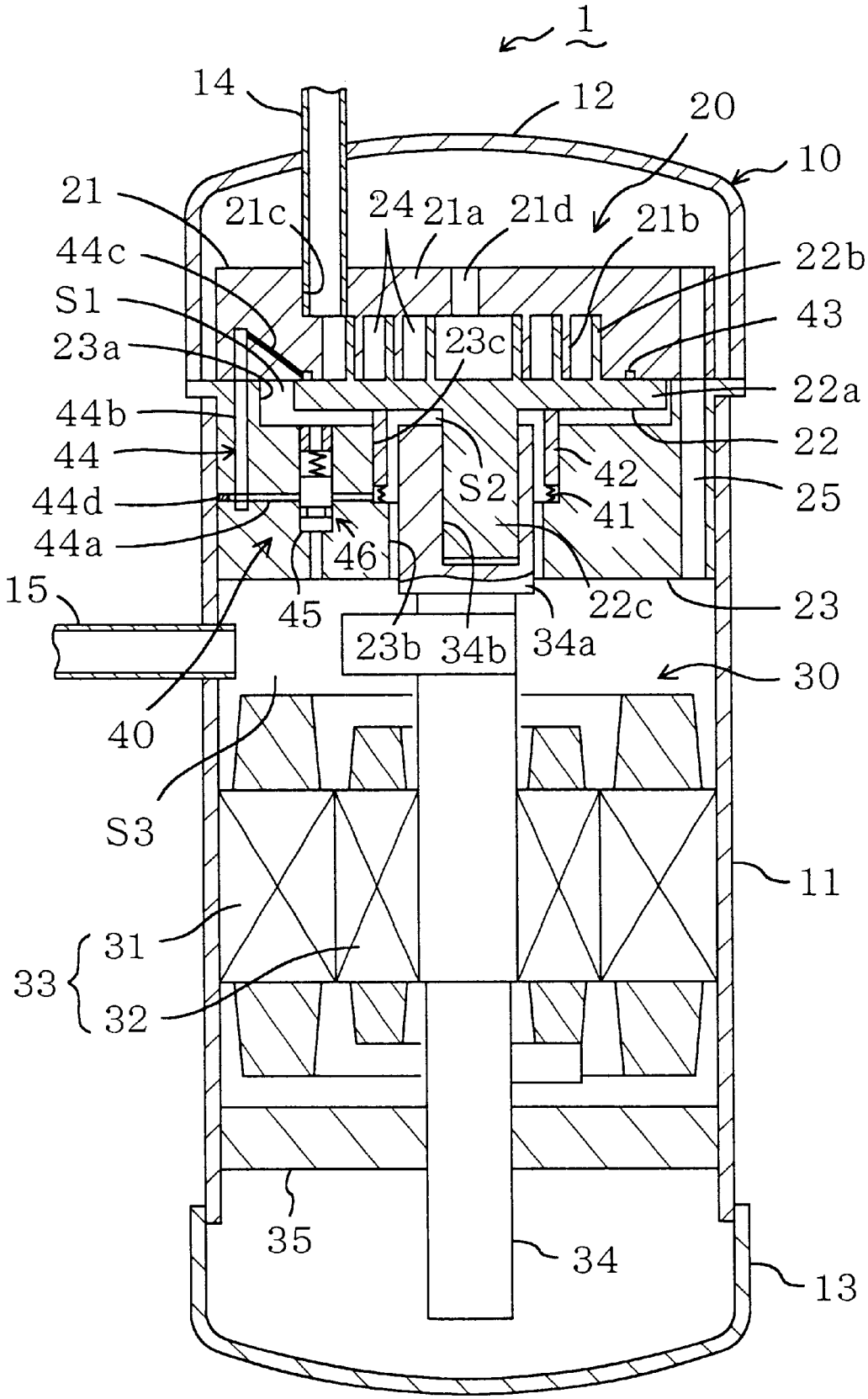
FIG. 1 is a longitudinal cross-sectional view showing the entire structure of a scroll type compressor according to a first embodiment of the present invention.

A scroll type compressor (1) according the first embodiment is used, for example, in a refrigerant circuit that goes through a vapor-compression type refrigeration cycle in an air conditioner or the like, to compress low-pressure refrigerant sucked from an evaporator and then discharge it to a condenser. As shown in FIG. 1, this scroll type compressor (1) has a compression mechanism (20) and a driving mechanism (30) for driving the compression mechanism (20) which are contained inside of a casing (10). The compression mechanism (20) is disposed in an upper section inside of the casing (10), while the driving mechanism (30) is disposed in a lower section inside of the casing (10).

The casing (10) is formed of a body (11) formed in a cylinder and dished end plates (12, 13) respectively fixed to top and bottom ends of the body (11). The upper end plate (12) is fixed to the below-described frame (23) fixed to the top end of the body (11), while the lower end plate (13) is fitted into a lower end portion of the body (11) and then fixed thereto.

The driving mechanism (30) is formed of: a motor (33) made up of a stator (31) fixed to the body (11) of the casing (10) and a rotor (32) disposed inside of the stator (31); and a drive shaft (34) fixed to the rotor (32) of the motor (33). The drive shaft (34) is connected at its upper end portion to the compression mechanism (20). Further, the lower end portion of the drive shaft (34) is rotatably supported to a bearing (35) fixed to the lower end portion of the body (11) of the casing (10).

The compression mechanism (20) includes a fixed scroll (21), a movable scroll (22) and the frame (23). The frame (23) is fixed to the body (11) of the casing (10), as described above. Further, the frame (23) divides an inner space of the casing (10) into upper and lower sections.

The fixed scroll (21) is formed of an end plate (21*a*) and a volute (involute) lap (21*b*) formed on the bottom face of the end plate (21*a*) . The end plate (21*a*) of the fixed scroll (21) is fixed to the frame (23) and is thereby unitary with the frame (23). The movable scroll (22) is formed of an end plate (22*a*) and a volute (involute) lap (22*b*) formed on the top face of the end plate (22*a*).

The lap (21*b*) of the fixed scroll (21) and the lap (22*b*) of the movable scroll (22) are meshed with each other. Further, a space between contact portions of both the laps (21*b*, 22*b*) located between the end plate (21*a*) of the fixed scroll (21) and the end plate (22*a*) of the movable scroll (22) is formed as a compression space (24). This compression space (24) is arranged to compress refrigerant in a manner so that the volume between both the laps (21*b*, 22*b*) contracts toward their center as the movable scroll (22) travels bodily around the fixed scroll.

In the end plate (21*a*) of the fixed scroll (21), an inlet port (21*c*) for low-pressure refrigerant is formed at a peripheral edge of the compression space (24) and a discharge port (21*d*) for high-pressure refrigerant is formed at the center of the compression space (24). An inlet pipe (14) fixed to the upper end plate (12) of the casing (10) is fixed to the inlet port (21*c*) for refrigerant, and the inlet pipe (14) is connected to the unshown evaporator of the refrigerant circuit. A flow channel (25) for guiding high-pressure refrigerant downward of the frame (23) is formed vertically through the end plate (21*a*) of the fixed scroll (21) and the frame (23). Further, a discharge pipe (15) for discharging high-pressure refrigerant is fixed to a middle portion of the body (11) of the casing (10), and the discharge pipe (15) is connected to the unshown condenser of the refrigerant circuit.

The end plate (22*a*) of the movable scroll (22) is formed with a scroll shaft (22*c*) that extends beyond the bottom face thereof. The scroll shaft (22*c*) is inserted into a connecting bore (34*b*) of a large-diameter part (34*a*) provided at the top end portion of the drive shaft (34). The connecting bore (34*b*) is formed at a position offset relative to the rotation axis of the drive shaft (34) so as to travel the movable scroll (22) bodily around the fixed scroll (21). Further, between the end plate (22*a*) of the movable scroll (22) and the frame (23), an anti-rotation member (not shown) such as an Oldham mechanism is provided to allow only bodily travel of the movable scroll (22) around the fixed scroll (21).

The drive shaft (34) is provided with, although not shown, a centrifugal pump and an oiling channel. The centrifugal pump is provided at the lower end portion of the drive shaft (34) and is arranged to pump up unshown lubricating oil, which has been stored in the lower section inside of the casing (10), with the rotation of the drive shaft (34). The oiling channel extends vertically in the drive shaft (34) and is communicated with oil feeding ports provided in respective sliding parts to supply the lubricating oil having been pumped up by the centrifugal pump to the respective sliding parts.

In this first embodiment, the pressure of the lubricating oil is used to press the movable scroll (22) against the fixed scroll (21) and the pressing force is controlled in accordance with the variation in the compression ratio with the change in operating conditions (such as a rise in high pressure) of the air conditioner. Therefore, a specific structure of the pressing means (40) will be described below.

First, the frame (23) is formed at its top face with a first recess (23*a*) somewhat larger in size than the moving range of the movable scroll (22). Further, a through hole (23*b*) somewhat larger in diameter than the large-diameter part (34*a*) of the drive shaft (34) is formed centrally at the bottom face of the frame (23), and a second recess (23*c*) somewhat larger in diameter than the through hole (23*b*) is formed between the first recess (23*a*) and the through hole (23*b*) . The second recess (23*c*) is provided with a sealing member (42) that is pressed into contact with the back face (bottom face) of the end plate (22*a*) of the movable scroll (22) by a spring (41).

This sealing member (42) separates a first space (S1) and a second space (S2) which are located on outer and inner diameter sides of the sealing member (42), respectively. High-pressure lubricating oil is supplied to the second space (S2) by the unshown centrifugal pump. Accordingly, the second space (S2) constitutes a high-pressure space (high-pressure oil working space) for allowing the high pressure of the lubricating oil to act on the back face (bottom face) of the end plate (22*a*) of the movable scroll (22), while the first space (S1) constitutes a low-pressure space.

Next, with reference to FIGS. 2 to 5, description will be made about an arrangement wherein a pressing means (40) of the first embodiment suppresses the pressing force of the movable scroll (22) against the fixed scroll (21) when the compression ratio is equal to or more than a predetermined value.

Figure 2:
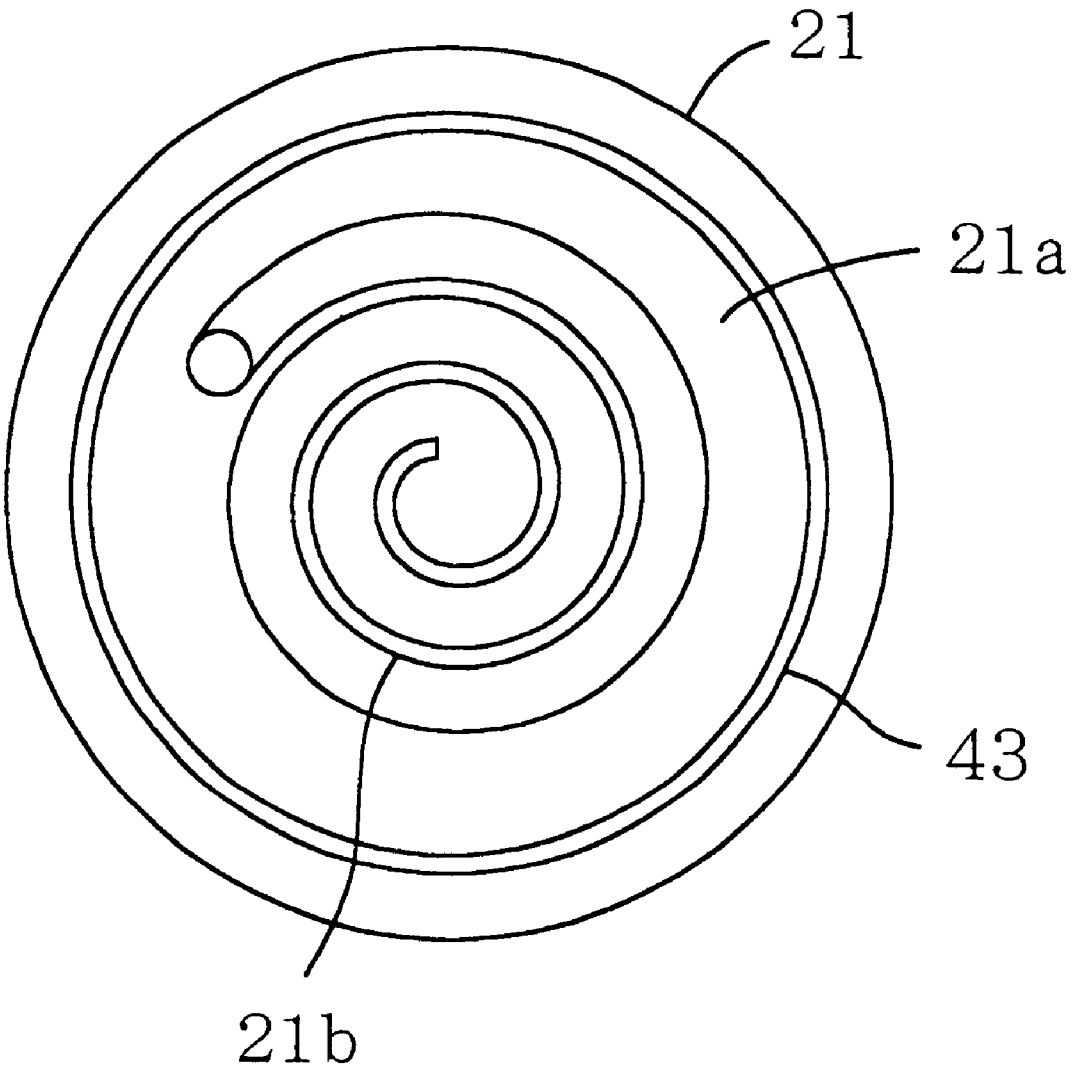
FIG. 2 is a bottom view of a fixed scroll.

As shown in FIG. 2 which is a bottom view of the fixed scroll (21), the bottom face of the end plate (21*a*) of the fixed scroll (21) is formed on the outer periphery side of the lap (21*b*) with an annular oil groove (43). This oil groove (43) is formed as a space for allowing the high pressure to act on the surface of the fixed scroll in contact with the top face of the end plate (22*a*) of the movable scroll (22). Although not shown, the oil groove (43) does not have a fully annular form but has a partially slightly discontinued form and the discontinued portion in its circumference in the bottom face of the end plate (21*a*) is formed with a fine groove extending in a radial direction. This fine groove allows the first space (S1) to communicate with the inlet side of the compression space (24) to keep the first space (S1) at a low pressure. However, it is to be noted that the specific forms of constituent parts including the oil groove (43) are determined adequately depending upon the specific structure of the scroll type compressor (1) and in some cases the compressor can have a structure that does not include the above-mentioned fine groove.

Further, as shown in FIG. 1, the fixed scroll (21) and the frame (23) are formed with a high-pressure oil introduction passage (44) for introducing the high-pressure oil in the second space (S2) into the oil groove (43). This high-pressure oil introduction passage (44) consists of a first passage (44*a*) extending radially outward from the second recess (23*c*) of the frame (23), a second passage (44*b*) formed to communicate with the first passage (44*a*) and extend vertically from the frame (23) to the fixed scroll (21), and a third passage (44*c*) formed in the fixed scroll (21) to communicate from the second passage (44*b*) to the oil groove (43). The first passage (44*a*) is formed by boring the frame (23) from the outer periphery toward the center, and therefore sealed at the outside end thereof by a plug (44*d*).

The frame (23) is provided with a high-pressure oil introduction valve (45) for opening/closing the high-pressure oil introduction passage (44). Further, the high-pressure oil introduction passage (44) and the high-pressure oil introduction valve (45) constitute a high-pressure oil introducing means (46) for introducing the high-pressure oil in the second space (S2), which is the high-pressure oil working space, into the oil groove (43) when the compression ratio is higher than the predetermined value. When the compression ratio is higher than the predetermined value, the compressor is approximately in a high pressure differential condition of a large pressure differential between a high-pressure space (S3) and the low-pressure space (S1) in the casing. When the compression ratio is equal to or less than the predetermined value, the compressor is approximately in a low pressure differential condition.

The high-pressure oil introduction valve (45) is arranged to introduce the high-pressure oil into the oil groove (43) when the compression ratio exceeds the predetermined value in a manner to open the high-pressure oil introduction passage (44) at high pressure differentials while closing it at low pressure differentials. In other words, the working pressure of the high-pressure oil introduction valve (45) (the pressure differential between high and low pressures: in this case, the pressure differential between the high-pressure space (S3) and the low-pressure space (S1)) is set at a predetermined value so that the high-pressure oil introduction valve (45) can be actuated depending upon the variation in the compression ratio.

Figure 3:
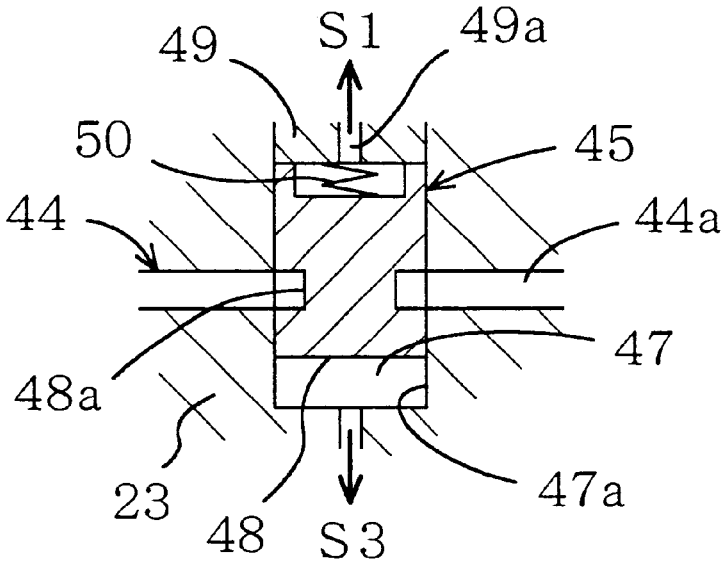
FIG. 3 is an enlarged cross-sectional view showing a high-pressure oil introduction valve in its open position.
Figure 4:
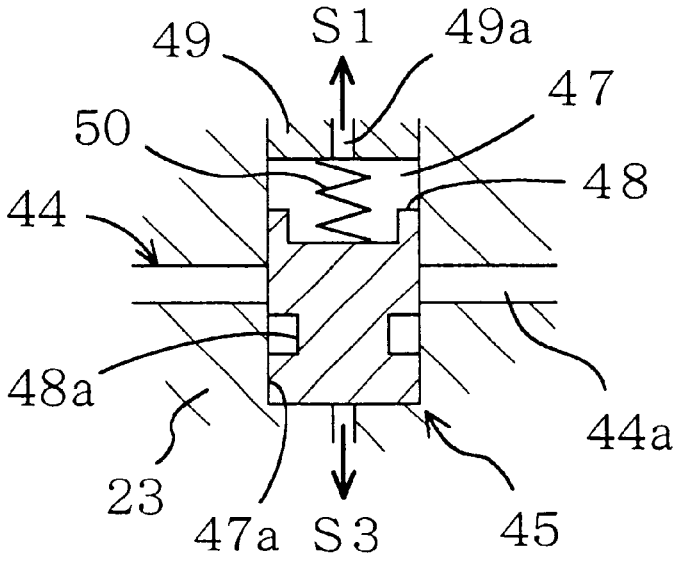
FIG. 4 is an enlarged cross-sectional view showing the high-pressure oil introduction valve in its closed position.

Specifically, as shown in FIGS. 3 and 4 which are enlarged cross-sectional views, the high-pressure oil introduction valve (45) includes a cylinder (47) formed in the frame (23) to traverse the high-pressure oil introduction passage (44), and a piston-like valve body (48) provided for reciprocating movement in the cylinder (47).

The cylinder (47) communicates at its upper end with the low-pressure space (S1) while communicating at its bottom end with the high-pressure space (S3) below the frame (23). An upper part (47*a*) of the cylinder (47) is formed in a larger diameter and contains the valve body (48) inserted therein. A plug (49) formed centrally with a through hole (49*a*) is fixed to the upper end of the cylinder (47), and a spring (50) as an urging means for urging the valve body (48) downward is provided between the plug (49) and the valve body (48).

When, for example, the high-pressure space (S3) reaches a predetermined pressure so that the pressure differential between high and low pressures exceeds the preset value, the valve body (48) moves to its open position (see FIG. 3) that is an upper limit position in its movable range to open the high-pressure oil introduction passage (44). On the other hand, when the high-pressure space (S3) is equal to or lower than the predetermined pressure so that the pressure differential between high and low pressures does not reach the preset value, the valve body (48) moves to its closed position (see FIG. 4) that is a lower limit position in its movable range to close the high-pressure oil introduction passage (44). Inversely speaking, the urging force of the spring (50) for urging the valve body (48) toward the closed position is set so that the valve body (48) performs the above movement in accordance with the pressure differential between the low-pressure space (S1) and the high-pressure space (S3). Thus, the high-pressure oil introduction valve (45) can be switched substantially in accordance with the variation in the compression ratio.

Figure 5:
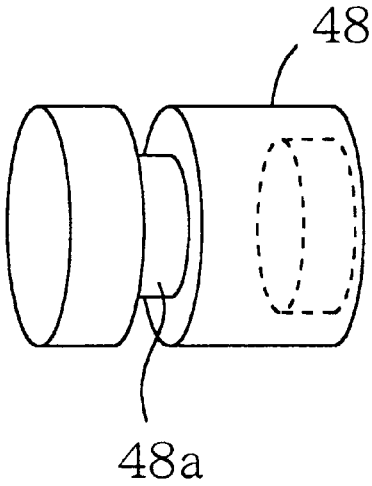
FIG. 5 is a perspective view showing a valve body of the high-pressure oil introduction valve.

The valve body (48) is formed with a communication passage (48*a*) to open the high-pressure oil introduction passage (44) at the open position shown in FIG. 3 at high pressure differentials while blocking the high-pressure oil introduction passage (44) at the closed position shown in FIG. 4 at low pressure differentials. Specifically, as shown in FIG. 5, the communication passage (48*a*) of the valve body is constituted by a circumferential channel formed in the outer peripheral surface of the valve body (48).

Next, behavior of the above scroll type compressor (1) in operation will be described.

First, when the motor (33) is driven, the rotor (32) rotates relative to the stator (31) and the drive shaft (34) thereby rotates. Upon rotation of the drive shaft (34), the connecting bore (34*b*) of the large-diameter part (34*a*) travels bodily around the rotation axis of the drive shaft (34) and concurrently the movable scroll (22) travels bodily around the fixed scroll (21) without rotating on its axis. Thereby, low-pressure refrigerant is sucked into the peripheral edge of the compression space (24) through the inlet pipe (14), compressed to a high pressure by a change in volume of the compression space (24) and then discharged upward of the fixed scroll (21) through the discharge port (21*d*) at the center of the compression space (24).

This refrigerant flows into below the frame (23) through the flow channel (25) formed through both the fixed scroll (21) and the frame (23) so that the casing is filled with the high-pressure refrigerant and the refrigerant is discharged through the discharge pipe (15). Then, the refrigerant experiences condensation, expansion and evaporation processes in the refrigerant circuit and is sucked again into the compressor through the inlet pipe (14), followed by compression.

During operation, the lubricating oil stored in the casing (10) also rises to a high pressure and is fed into the second space (S2) through the oiling channel in the drive shaft (34) by the unshown centrifugal pump. Accordingly, the movable scroll (22) is pressed at its back face (bottom face) side against the fixed scroll (21) and therefore can be prevented from inclining (upsetting). It is to be noted that the area within which the high-pressure oil acts on the movable scroll (22) is preset so that the movable scroll (22) may not upset in the operating condition of a relatively low compression ratio.

On the other hand, when a change in the operating condition causes, for example, rise in the high pressure so that the compression ratio gradually increases, the pressing force of the movable scroll (22) against the fixed scroll (21) becomes larger and concurrently the pressure differential between the high-pressure space (S3) and the low-pressure space (S1) gradually increases. Then, when the pressure differential reaches the preset value determined in advance based on the compression ratio at which the movable scroll (22) may upset, the force developed by the high pressure of the high-pressure space (S3) becomes larger than the force obtained by the pressure of the low-pressure space (S1) and the urging force of the spring (49) so that the valve body (48) of the high-pressure oil introduction valve (45) moves upward in the cylinder (47) to shift to its open position as shown in FIG. 3.

Figure 6:
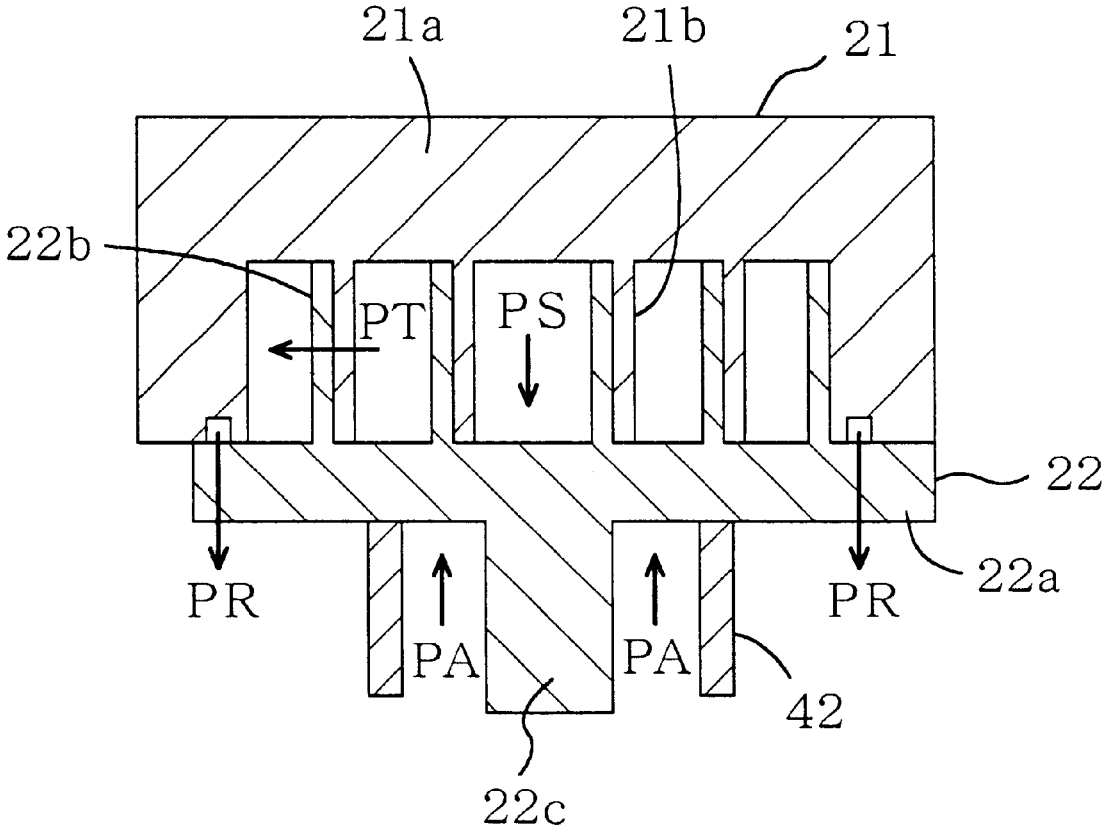
FIG. 6 is a schematic cross-sectional view showing forces acting on a movable scroll.
Figure 7:
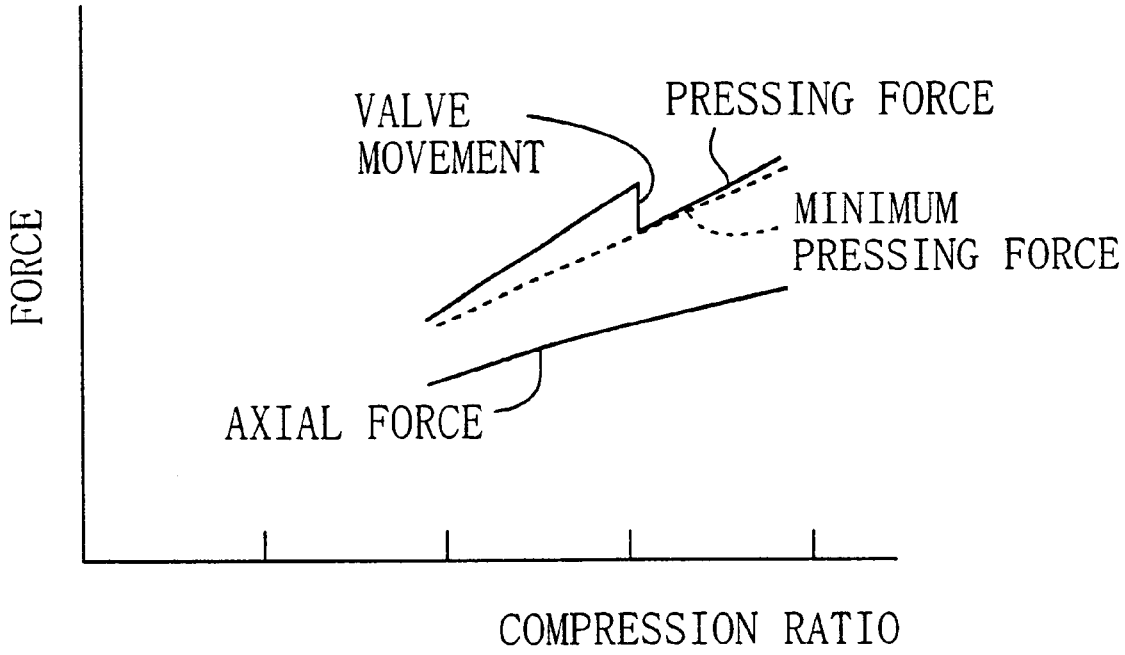
FIG. 7 is a graph showing the change in a pressing force of the movable scroll with the change in the compression ratio.

As a result, the high-pressure oil introduction passage (44) that has been closed up to then as shown in FIG. 4 is opened through the circumferential channel (48*a*) formed in the outer periphery of the valve body (48) so that the high-pressure oil in the second space (S2) is introduced into the oil groove (43). Therefore, a force PR in a direction to separate the movable scroll (22) away from the fixed scroll (21) acts on the movable scroll (22) as shown in FIG. 6, so that the pressing force is reduced once to a minimum value during valve movement as shown in FIG. 7. As the pressure differential further increases depending upon the subsequent operating condition (the variation in the compression ratio), the pressing force is gradually increased. During the time, the pressure of the high-pressure oil also gradually rises. Therefore, the inclination of rise in the pressing force during the time is gentler as compared with prior to the movement of the valve (45) and an over-pressing force can be prevented from being developed. It is to be noted that the inclination of rise in the pressing force can be controlled by adequately setting the area of the oil groove (43) or other conditions.

On the contrary, when a change in the operating condition causes, for example, drop in the high pressure so that the compression ratio gradually decreases and the pressure differential is thereby gradually lessened, the pressure of oil in the oil groove (43) also gradually drops. Then, when the pressure differential falls to or below the preset value, the valve body (48) of the high-pressure oil introduction valve (45) shifts to its closed position so that the supply of the high-pressure oil to the oil groove (43) stops. Therefore, when the compression ratio is below the predetermined value, the force PR of FIG. 6 does not act. As a result, the pressing force of the movable scroll (22) against the fixed scroll (21) can be prevented from failing.

As can be understood from the above description, according to the first embodiment, the upset of the movable scroll (22) at low compression ratios is prevented by pressing the movable scroll (22) against the fixed scroll (21) with an appropriate pressing force, while the excess of the pressing force at high compression ratios is prevented by using the change in the pressure differential between the low-pressure space (SI) and the high-pressure space (S3) to open the high-pressure oil introduction valve (45) thereby introducing the high-pressure oil into the oil groove (43) between the fixed scroll (21) and the movable scroll (22).

Accordingly, at low compression ratios, since the upset of the movable scroll (22) due to lack of the pressing force does not occur, it can be prevented that the efficiency decreases due to leakage of the refrigerant. At high compression ratios, it can be prevented that mechanical loss is produced due to excess of the pressing force. As can be apparent from these points, an efficient operation can be implemented over the entire range from low compression ratio to high compression ratio.

Further, the upset of the movable scroll (22) is prevented by taking the second space (S2) as a high-pressure oil working space and pressing the movable scroll (22) against the fixed scroll (21), while the pressing force is suppressed by using the pressure differential between high and low pressures to introduce the high-pressure oil in the second space (S2) into the oil groove (43) in accordance with the variation in the compression ratio. Accordingly, mechanical loss can be prevented while effectively using the pressure in the compressor (1).

Further, in the specific arrangement, since the high-pressure oil introduction passage (44) is opened/closed by the high-pressure oil introduction valve (45) actuated with the pressure differential between the low-pressure space (SI) and the high-pressure space (S3) in the casing (10), this provides the high-pressure oil introduction valve (45) in a simple piston-type structure. Accordingly, it can be prevented that the entire structure of the compressor is mechanically complicated.

Although the pressure differential between high and low pressures does not change in complete accordance with the variation in the compression ratio, it can be said to change approximately in association with the variation in the compression ratio. Therefore, according to the first embodiment, the pressing force of the movable scroll (22) can be controlled substantially in accordance with the variation in the compression ratio. Further, although little mention has been made hereinbefore to the change in the low pressure, almost the same operations and effects can be exhibited even for the consideration of the generic case including the variation in the low pressure.

(Second Embodiment)

Next, a second embodiment of the present invention will be described with reference to FIG. 8.

In a scroll compressor (1) according to the second embodiment, the structure of the high-pressure oil introduction passage (44) differs from that in the first embodiment but other component parts have the same construction as in the first embodiment. FIG. 8 shows, in enlarged manner, only the structure of the high-pressure oil introduction passage (44) and its surroundings.

The high-pressure oil introduction passage (44) of this scroll type compressor (1), like the first embodiment, is formed from the fixed scroll (21) to the frame (23) to introduce the high-pressure oil in the second space (S2) into the annular oil groove (43) formed in the bottom face of the end plate (21*a*) of the fixed scroll (21). Further, the high-pressure oil introduction valve (45) which has been provided in the first embodiment is not provided in this embodiment.

The high-pressure oil introduction passage (44) consists of the first passage (44*a*) radially outward extending from the second recess (23*c*) of the frame (23), the second passage (44*b*) formed to communicate with the first passage (44*a*) and extend vertically from the frame (23) to the fixed scroll (21), and the third passage (44*c*) formed in the fixed scroll (21) to communicate from the second passage (44*b*) to the oil groove (43). The first passage (44*a*) is sealed at the outside end thereof by the plug (44*d*) like the first embodiment.

As a feature of the second embodiment, in the high-pressure oil introduction passage (44), the second passage (44*b*) is formed into a reduced-diameter part smaller in diameter than that of the first embodiment and the second passage (44*b*) constitutes a restriction section with a diameter of, for example, about 0.5 mm. Although the entire second passage (44*b*) serves as the restriction section in the second embodiment, it would be successful to provide the restriction section at least in part of the high-pressure oil introduction passage (44) including the first passage (44*a*), the second passage (44*b*) and the third passage (44*c*).

As can be understood from above, in the second embodiment, the high-pressure oil in the casing (10) is always supplied to the oil groove (43) between the fixed scroll (21) and the movable scroll (22) through the second passage (44*b*) of the high-pressure oil introduction passage (44). Further, according to the above arrangement, the pressing means (40) of the second embodiment also controls the pressing force of the movable scroll (22) against the fixed scroll (21) in accordance with the variation in the compression ratio.

Specifically, for example, in the condition of a low compression ratio induced by a drop in the high pressure, the pressing force (PA: see FIG. 6) of the movable scroll (22) against the fixed scroll (21) falls off and the counterpressing force (PR: see FIG. 6) also falls off. On the contrary, in the condition of a high compression ratio induced by a rise in the high pressure, the pressing force (PA) rises and the counter-pressing force (PR) also rises. In this manner, the difference between the pressing force and the counter-pressing force (i.e., the actual pressing force) varies. Although in fact the low pressure generally varies concurrently with the high pressure, also in this case, substantially the same effect can be regarded as being exhibited.

In this manner, according to the second embodiment, the pressing force of the movable scroll (22) against the fixed scroll (21) is controlled in accordance with the variation in the compression ratio by allowing the high pressure (discharge pressure) to always act on the oil groove (43).

As can be understood from above, in the second embodiment, when for example the high pressure is high so that the compression ratio is relatively large, the oil of higher pressure as compared with the case where the compression ratio is small (when for example the high pressure is low) acts on the oil groove (43). In contrast, when the compression ratio is small, the oil of smaller pressure as compared with the case where the compression ratio is large acts on the oil groove (43). Therefore, the pressing force of the movable scroll (22) against the fixed scroll (21) is controlled in accordance with the variation in the compression ratio with the change in the operating condition. Accordingly, at high compression ratios the pressing force (PA) is sufficiently suppressed while at low compression ratios the suppression of the pressing force (PA) is relieved.

Specifically, according to the second embodiment, if for example the area in the second space (S2) within which the high-pressure oil acts on the movable scroll (22) or the area in the oil groove (43) within which the high-pressure oil acts on the movable scroll (22) is preset so that the movable scroll (22) may not upset at low compression ratios, the movable scroll (22) can be prevented from being pressed against the fixed scroll (21) with a force stronger than required even at high compression ratios. It is to be noted that if the compressor is set so that an appropriate counter-pressing force (PR) can be obtained in the condition of a low compression ratio, the counter-pressing force (PR) may fail to some extent relative to the pressing force (PA) at high compression ratios depending upon the preset conditions. In this case, since a counter-pressing effect itself is inevitably developed, the actual pressing force of the movable scroll (22) against the fixed scroll (21) can be suppressed as compared with the conventional case. Accordingly, it is possible to suppress mechanical loss.

On the contrary, if the compressor is set so that an appropriate counter-pressing force (PR) can be obtained in the condition of a high compression ratio, in some cases the movable scroll (22) may be upset at low compression ratios. In the second embodiment, however, since the restriction section (44*b*) is provided, the oil is reduced in pressure when flowing through the high-pressure oil introduction passage (44) so that the counter-pressing force can be reduced. As a result, even if the movable scroll (22) upsets, it can immediately be recovered to its original un-upset position. Further, since the restriction section (44*b*) can restrain oil inflow into the oil groove (43) upon the upset, it can be prevented that the oil rapidly leaks off outside the compressor from the compression space (24) through the high-pressure space (S3). As can be understood from the above, according to the second embodiment, decrease in efficiency due to upset of the movable scroll (22) and oil shortage due to oil leakage can be suppressed to an extent that provides substantially no problem in terms of practicality.

As described so far, according to the second embodiment, since the actual pressing force of the movable scroll (22) against the fixed scroll (21) is always controlled in accordance with the variation in the compression ratio (variation in the high pressure or low pressure) with the change in the operating condition, the compressor can be operated over the entire range from low compression ratio to high compression ratio with higher efficiency than the prior art, like the first embodiment.

Further, even if the movable scroll (22) is upset in the condition of a low compression ratio, the oil is reduced in pressure by the restriction section (44*b*) so that the movable scroll (22) can be immediately recovered from the upset position and drop in oil level and oil shortage due to oil leakage can be suppressed. Furthermore, even if the counter-pressing force falls off to some extent at high compression ratios, a counter-pressing effect itself is inevitably developed. This provides higher efficiency as compared with the conventional case.

Moreover, the second embodiment has the advantage of a simpler structure as compared with the first embodiment and thereby has the effect of providing less probability of failure and higher reliability.

Figure 8:
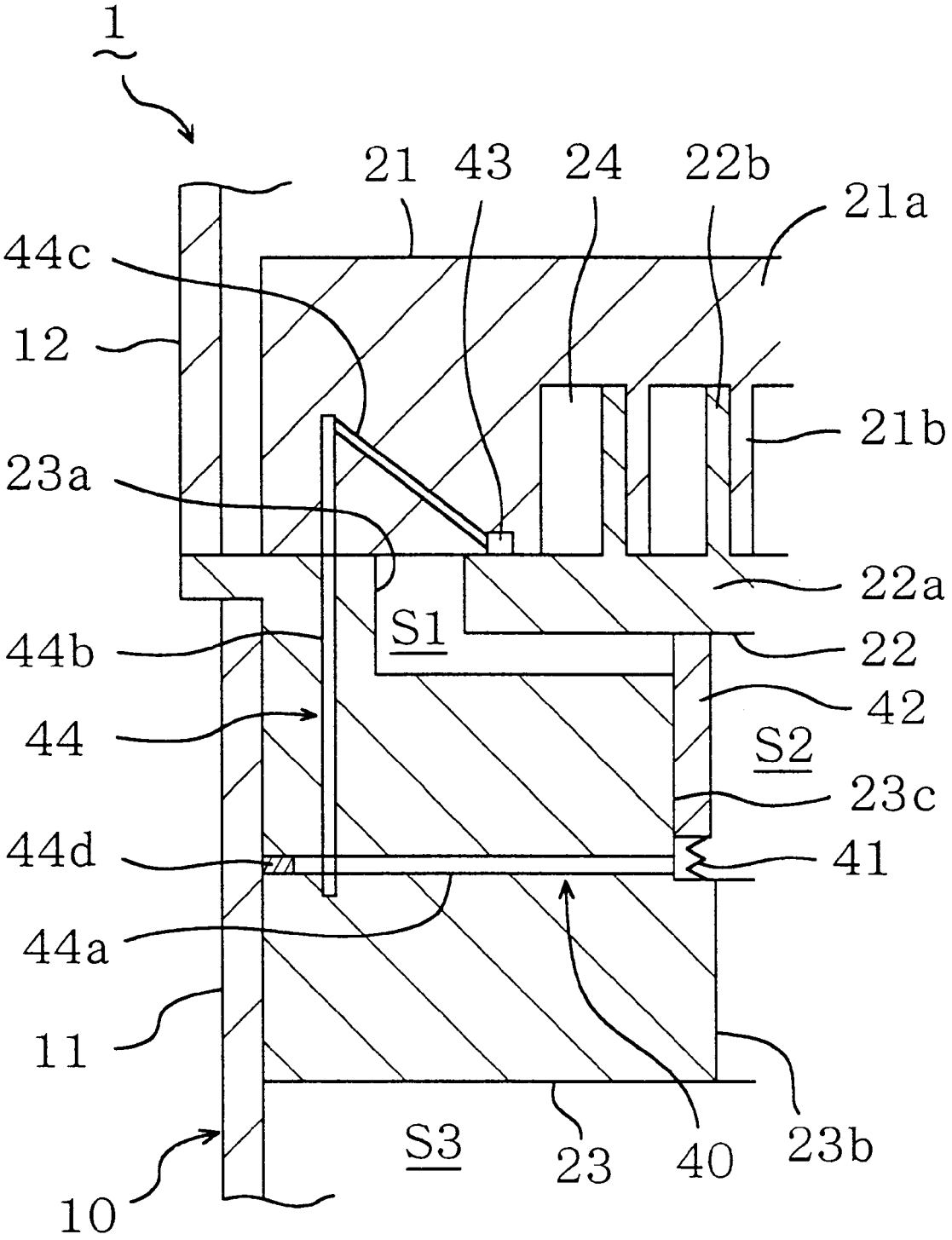
FIG. 8 is an enlarged cross-sectional view of an essential part of a scroll type compressor according to a second embodiment of the present invention.
Figure 9:
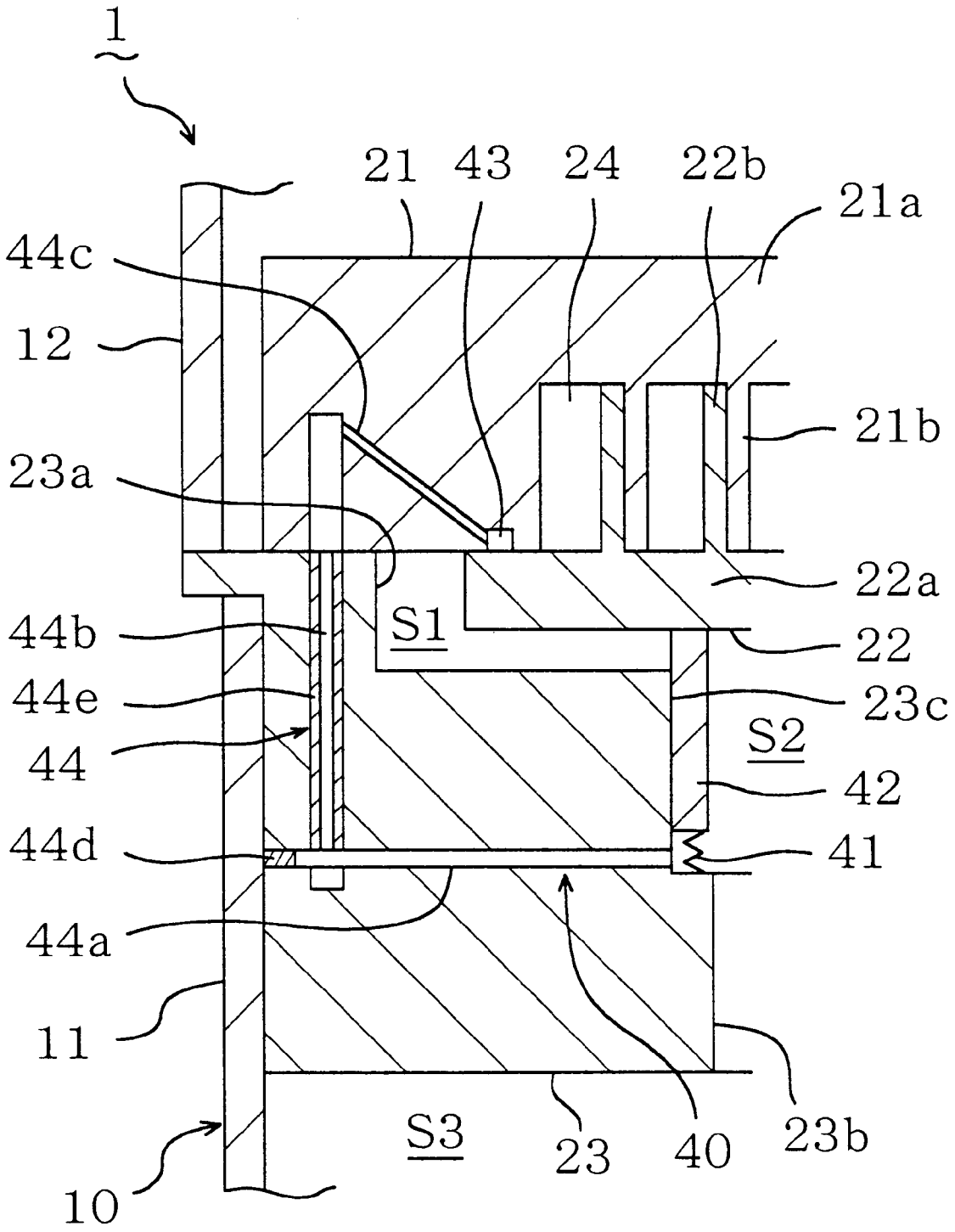
FIG. 9 is an enlarged cross-sectional view of an essential part of a first modified example of the second embodiment.

FIG. 9 shows a first modified example of the second embodiment. Although in the example of FIG. 8 the second passage (44*b*) itself is formed in a small diameter to serve as a restriction section, in this modified example the second passage (44*b*) itself has substantially the same diameter as in the first embodiment and the restriction section is formed by setting a capillary tube (44*e*) in the second passage (44*b*) at the side of the frame (23). Other specific structures are the same as in FIG. 8.

Such an arrangement provides the same operations and effects as obtained by the example of FIG. 8 and further provides the advantage of facilitating the manufacture of the compressor because of easier formation of the second passage (44*b*) as compared with the example of FIG. 8.

Figure 10:
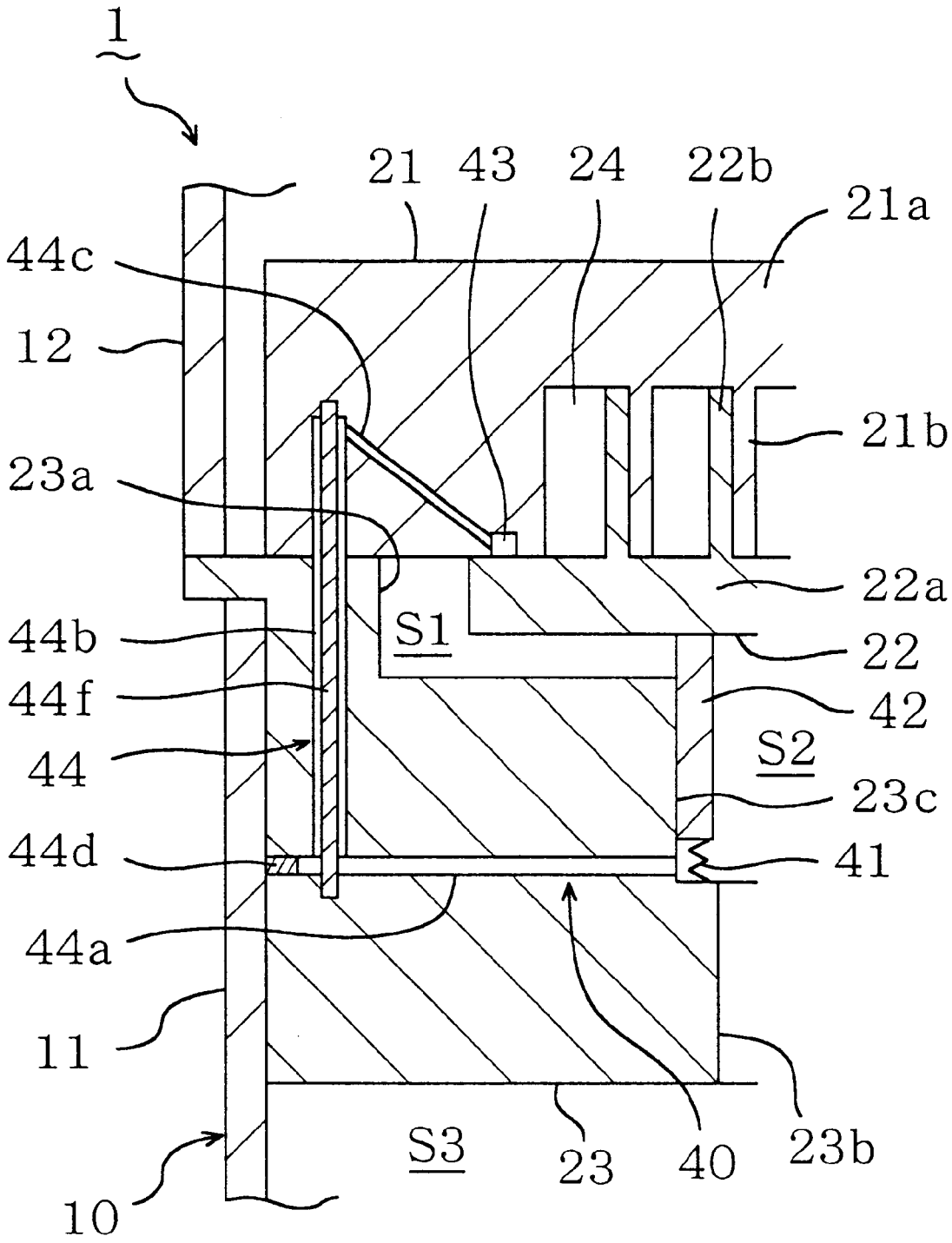
FIG. 10 is an enlarged cross-sectional view of an essential part of a second modified example of the second embodiment.

FIG. 10 shows a second modified example of the second embodiment. In this example, a bar-like member (44*f*) with a slightly narrower outer diameter than the diameter of the second passage (44*b*) is placed in the second passage (44*b*) instead of the capillary tube (44*e*) of FIG. 9. And, a narrow tube-like clearance is formed between the inner periphery of the second passage (44*b*) and the outer periphery of the bar-like member (44*f*) to constitute the restriction section. Other specific structures are the same as in FIGS. 8 and 9.

Such an arrangement provides the same operations and effects as obtained by the example of FIG. 8 and further provides the advantage of further facilitating the manufacture of the compressor as compared with the example of FIG. 9 because of easier placement of the bar-like member (44*f*) than the capillary tube (44*e*).

In the example as shown in the figure, the bar-like member (44*f*) is fixedly positioned by extending it beyond the top and bottom ends of the second passage (44*b*). However, the arrangement wherein the bar-like member (44*f*) is placed in the second passage (44*b*) can be appropriately changed. For example, a simple arrangement wherein the bar-like member (44*f*) slightly shorter than the second passage (44*b*) is inserted into the second passage (44*b*) without fixing it is also possible.

(Third Embodiment)

Figure 11:
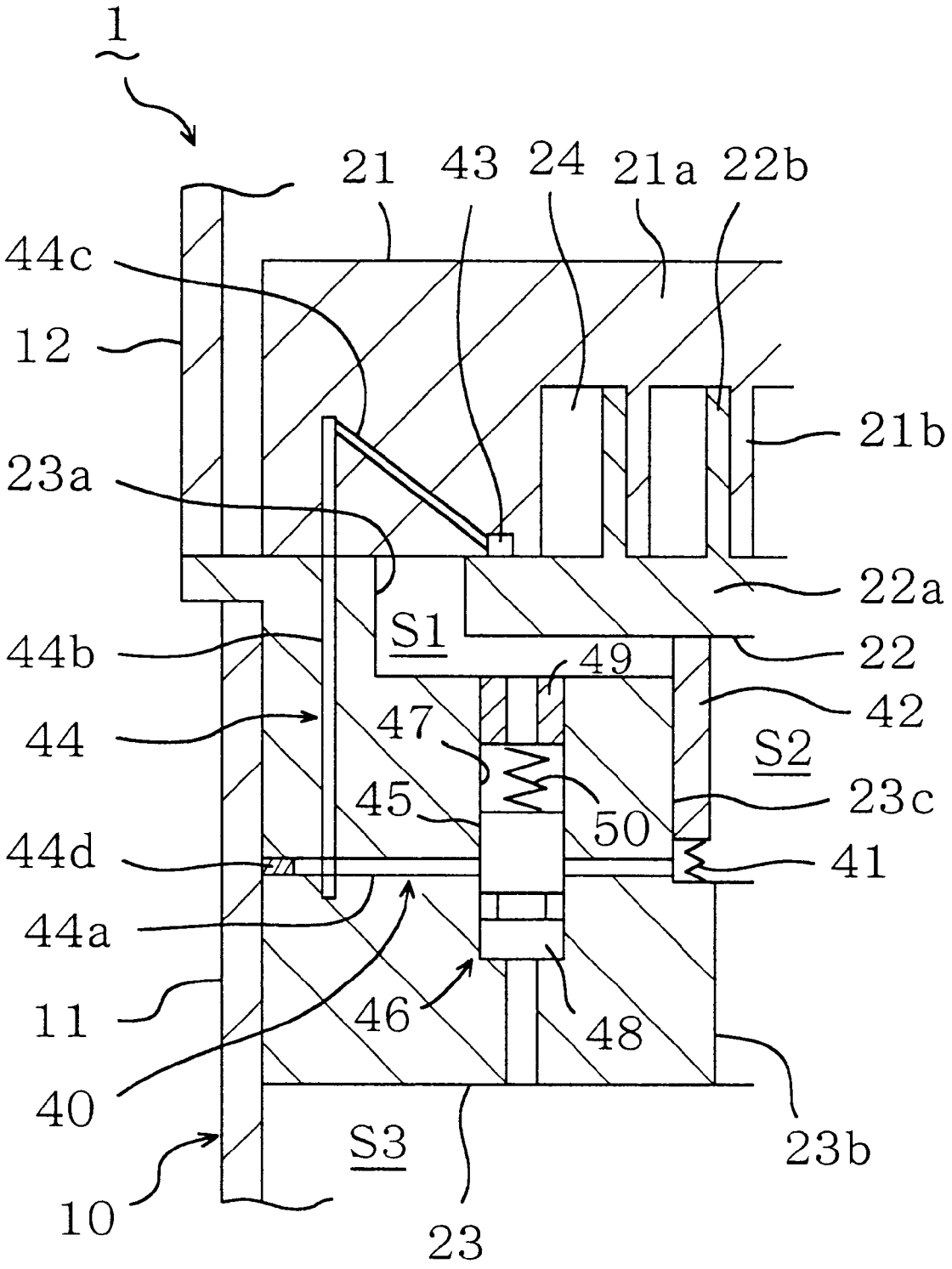
FIG. 11 is an enlarged cross-sectional view of an essential part of a scroll type compressor according to a third embodiment of the present invention.
Figure 12:
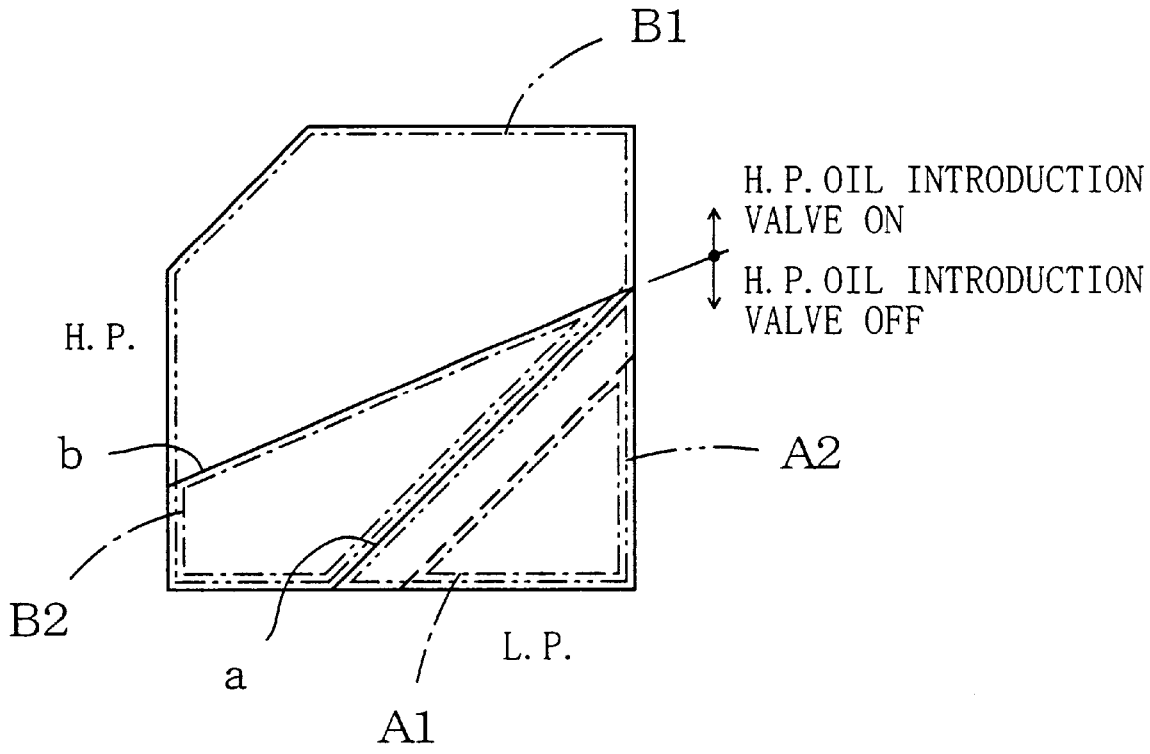
FIG. 12 is a first diagram showing the relation between the upset of the movable scroll and the operation of the high-pressure oil introduction valve in an operating range of the scroll type compressor of FIG. 11.

Next, a third embodiment of the present invention will be described with reference to FIGS. 11 to 13.

In a scroll type compressor (1) according to the third embodiment, the structure of the pressing means (40) differs from those in the first and second embodiments, and specifically, the high-pressure oil introduction passage (44) is provided with the high-pressure oil introduction valve (45) like the first embodiment and the second passage (44*b*) of the high-pressure oil introduction passage (44) is formed in a small diameter to serve as a restriction section like the second embodiment.

The high-pressure oil introduction valve (45) is set to make the urging force of the spring (50) slightly smaller than that in the first embodiment. Therefore, the high-pressure oil introduction valve (45) has a slightly lower working pressure than the first embodiment. In other words, the high-pressure oil introduction passage (44) will open with a slightly smaller pressure differential between the high-pressure space (S3) and the low-pressure space (S1) (at a lower compression ratio than the first embodiment).

Other component parts are arranged in the same manner as in the first and second embodiments. It is to be noted that although the high-pressure oil introduction valve (45) is provided upstream of the restriction section (44*b*) in the third embodiment, the restriction section (44*b*) may be provided upstream of the high-pressure oil introduction valve (45).

In the first embodiment, the arrangement is such that the high-pressure oil introduction passage (44) is provided with the high-pressure oil introduction valve (45) only, the pressure differential between high and low pressures with which the high-pressure oil introduction valve (45) is actuated is set at a value based on the predetermined compression ratio and the pressing force of the movable scroll (22) against the fixed scroll (21) is suppressed, only when the compression ratio exceeds the predetermined value, using the high pressure. Therefore, if the high-pressure introduction valve (45) is set so as not to be actuated in the entire region (A2) in which the upset can occur in the working range of the scroll type compressor shown in FIG. 12 (an operating range diagram wherein the ordinate represents the high pressure and the abscissa represents the low pressure), since both the inclinations of the boundary line (a) of the upset region and the boundary line (b) for the working pressure are normally not fully equal to each other, this may cause, in the region (B1) in which the upset does not occur, an over-pressing condition (the region (B2)) in which the movable scroll (22) is not counter pressed. The reason why both the inclinations of the boundary lines (a) and (b) are different from each other is that the upset of the movable scroll (22) is generally caused by the variation in the compression ratio, while the actuation of the high-pressure introduction valve (45) in the first and third embodiments depends on the pressure differential between the high-pressure space (S3) and the low-pressure space (S1) as an alternative value for the compression ratio.

Figure 13:
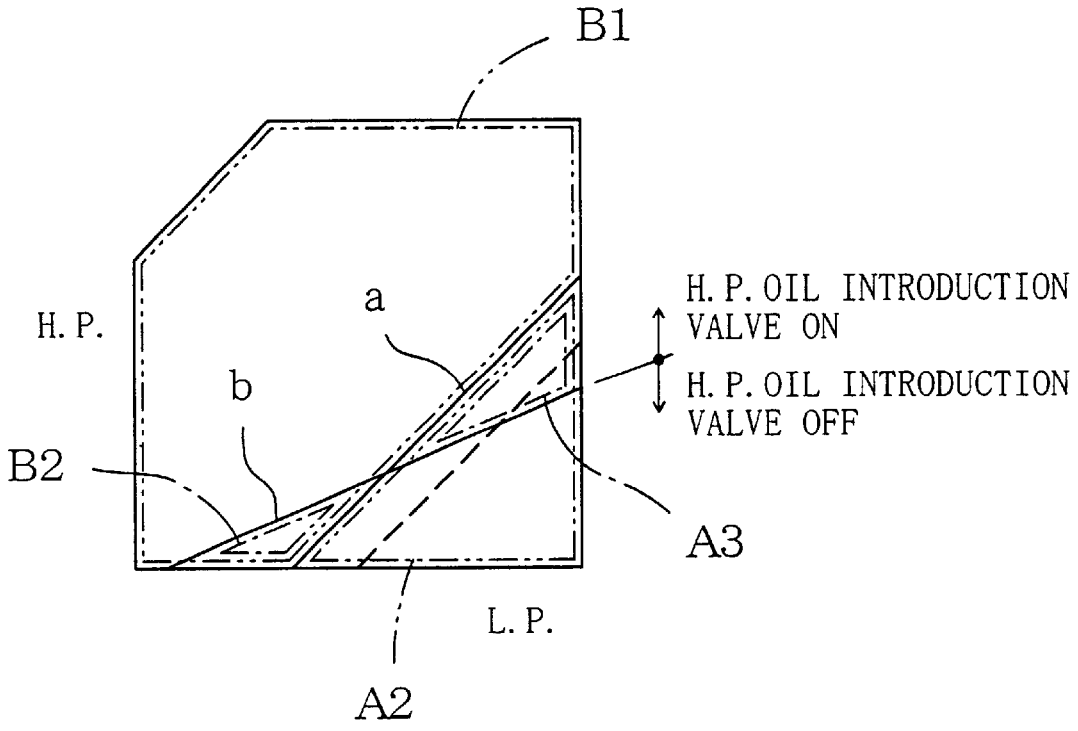
FIG. 13 is a second diagram showing the relation between the upset of the movable scroll and the operation of the high-pressure oil introduction valve in the operating range of the scroll type compressor of FIG. 11.
Figure 14:
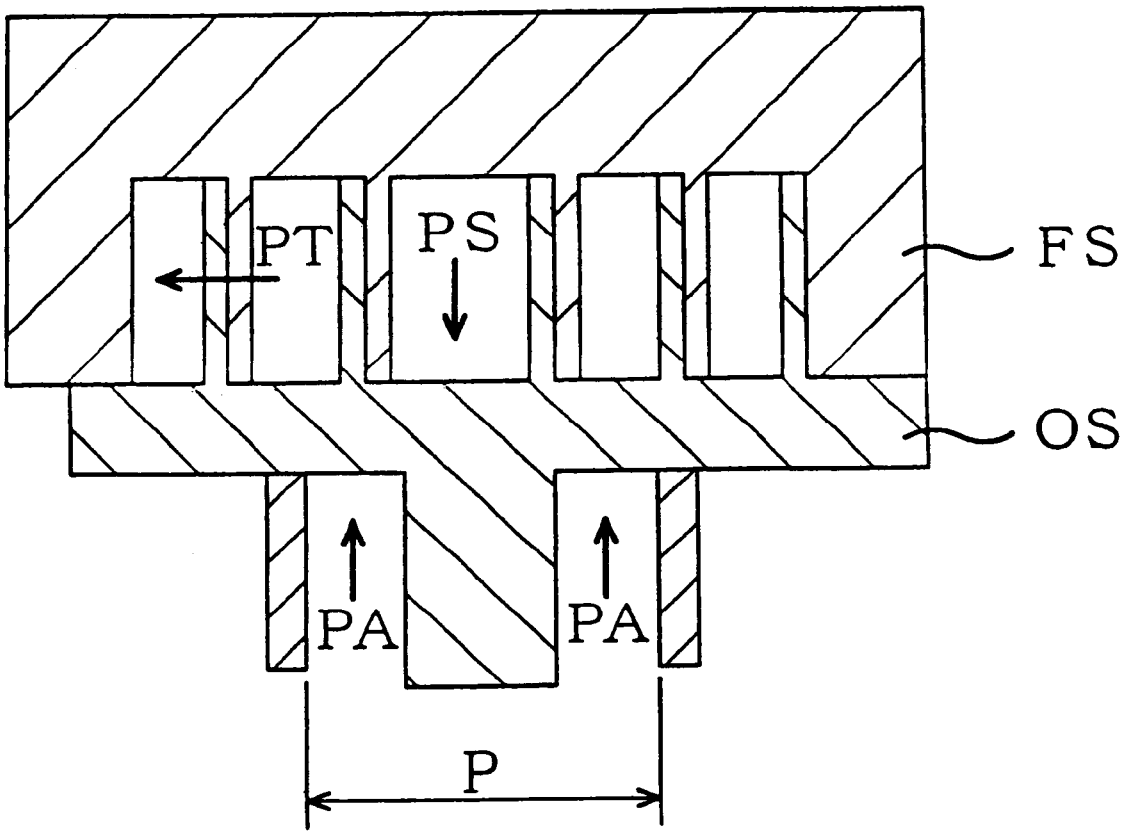
FIG. 14 is a schematic cross-sectional view showing forces acting on a movable scroll of a conventional scroll type compressor.
Figure 15:
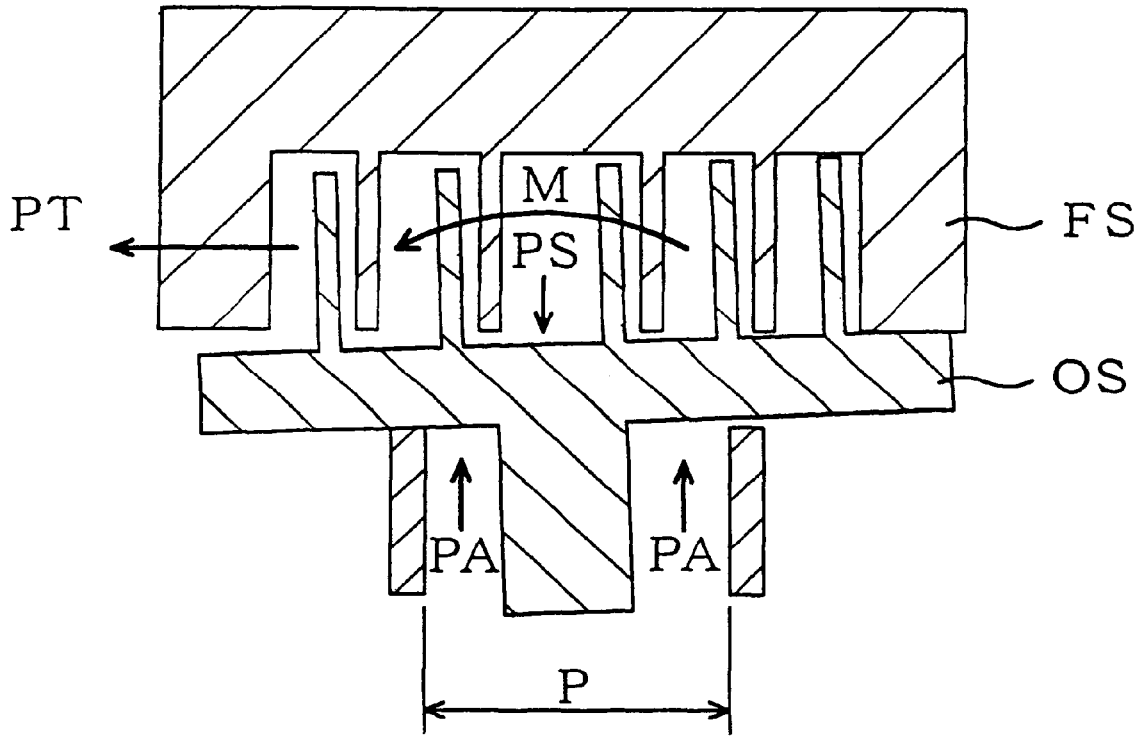
FIG. 15 is a cross-sectional view showing a state that the movable scroll of FIG. 14 is inclining.
Figure 16:
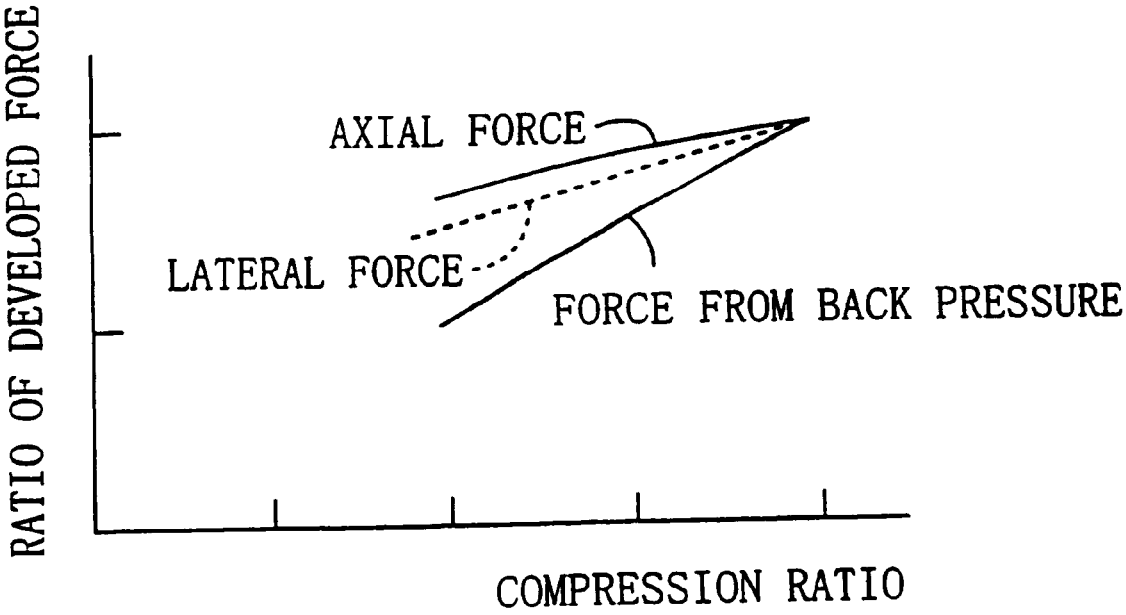
FIG. 16 is a first graph showing the change in the pressing force of the movable scroll with the variation in the compressing ratio in the conventional scroll type compressor.
Figure 17A:
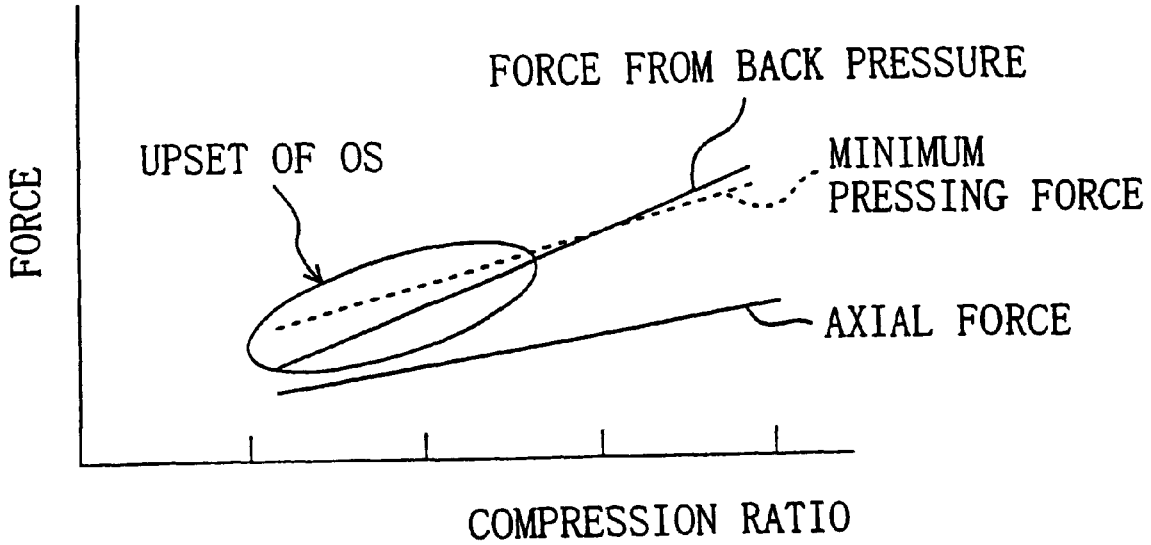
FIGS. 17A and 17B are second graphs showing the change in the pressing force of the movable scroll with the variation in the compressing ratio in the conventional scroll type compressor.
Figure 17B:
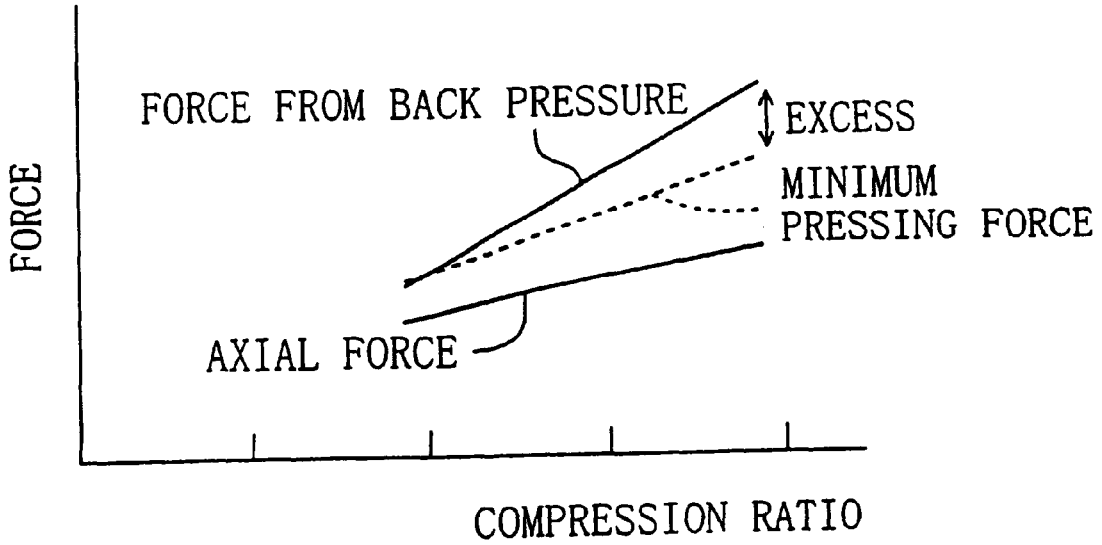
PRIOR ART Fig. 17B

In the third embodiment, however, since the working pressure of the high-pressure oil introduction valve (45) is lowered as shown in FIG. 13, the over-pressing region (B2) can be reduced. Simply lowering the working pressure of the high-pressure oil introduction valve (45) may cause an over-counter-pressing condition (the region (A3)) in which the movable scroll (22) is counter-pressed within the regions (A2 or A1) in which the upset of the movable scroll (22) may occur. In the third embodiment, however, since the restriction section (44*b*) is provided in the high-pressure oil introduction passage (44), even if the upset occurs, the oil is reduced in pressure in the restriction section (44*b*) while flowing through the high-pressure oil introduction passage (44) so that the movable scroll (22) can immediately be recovered from its upset position and oil leakage can also be prevented.

If the actuation of the high-pressure oil introduction valve (45) is also set depending upon the compression ratio, both the inclinations of the boundary lines (a) and (b) are substantially matched with each other. It will be thereby possible to prevent the over-pressing region (B2) and the over-counter-pressing region (A3) from occurring.

As described so far, according to the third embodiment, since not only the high-pressure oil introduction valve (45) but also the restriction section (44*b*) for reducing the pressure of the high-pressure oil are provided in the high-pressure oil introduction passage (44), they enable immediate recovery of the movable scroll (22) from its upset position while suppressing the occurrence of oil leakage in the over-counter-pressing region (A3). Further, since the over-pressing region (B2) can be reduced, this provides further stable operation over the entire range from low compression ratio to high compression ratio.

(Other Embodiments)

The present invention may have the following structures for the above respective embodiments.

For example, in the fist and third embodiments, the high-pressure oil introduction valve (45) takes the form of a piston-type on-off valve. However, the high-pressure oil introduction valve (45) may be an on-off valve of any other type. Further, use may be made of an on-off valve actuated by not the pressure differential between the high-pressure space (S3) and the low-pressure space (S1) like the first and third embodiments but the pressure differential between the inlet pipe (14) and the discharge pipe (15). Furthermore, the compression ratio may be calculated through the detection of the refrigerant inlet pressure (low pressure) in the inlet pipe (14) and the refrigerant discharge pressure (high pressure) in the discharge pipe (15) and the pressing force of the movable scroll (22) may be controlled by actuating the high-pressure oil introduction valve (45) in accordance with the calculated compression ratio. In this manner, the pressing force of the movable scroll (22) can be controlled further exactly in accordance with the variation in the compression ratio.

Further, the suppression of the pressing force that is to be effected when the compression ratio or the pressure differential between high and low pressures exceeds the predetermined value may be made using any pressure other than the pressure of the high-pressure oil, such as a refrigerant pressure. To sum up, according to the present invention, in the arrangement wherein the movable scroll (22) is pressed against the fixed scroll (21) with the high-pressure oil or the like, the pressing force of the movable scroll (22) against the fixed scroll (21) may be suppressed only when the compression ratio (or for example the pressure differential between high and low pressures) exceeds the predetermined value like the first embodiment, or the pressing force may be suppressed by always counter-pressing the movable scroll (22) with the high-pressure oil having passed through the high5 pressure oil introduction passage (44) like the second embodiment, or the pressing force of the movable scroll (22) may be controlled in accordance with the variation in the compression ratio (or for example the pressure differential between high and low pressures) by combining the above two manners like the third embodiment.

Furthermore, in the above embodiments, the oil groove (43) is formed annularly. However, its specific form is not limited to the annular groove so long as it is a space which is located between the contact surfaces of the fixed scroll (21) and the movable scroll (22) and into which the high-pressure oil is introduced. Further, in the above embodiments, the high-pressure oil in the second space (S2) is allowed to act on the oil groove (43) in accordance with the variation in the compression ratio with the change in the operating condition. However, the high-pressure oil stored in the lower section inside of the casing (10) may be fed directly to the oil groove (43).

Further, the second embodiment has the structure in which the restriction section (44*b*) is provided in the high pressure oil introduction passage (44). However, the restriction section (44*b*) may not necessarily be provided. The provision of the restriction section (44*b*) is highly effective in early recovering the movable scroll (22) and preventing oil leakage when the movable scroll (22) has been upset. However, even if the restriction section (44*b*) is not provided, it is possible, depending upon setting of the areas of the high-pressure oil working space (S2) and the oil groove (43), to prevent the pressing force of the movable scroll (22) against the fixed scroll (21) from being excessive at high compression ratios while preventing the pressing force from failing at low compression ratios.

What is claimed is:

1. A scroll type compressor comprising: a fixed scroll (21) fixed inside of a casing (10); a movable scroll (22) meshed with the fixed scroll (21); and pressing means (40) for pressing the movable scroll (22) against the fixed scroll (21), said pressing means (40) being arranged so as to have a high-pressure space (S2) that serves a back face side of the movable scroll (22) and to suppress a pressing force of the movable scroll (22) against the fixed scroll (21) when a compression ratio exceeds a predetermined value, said pressing means (40) comprising an oil groove (43) formed between contact surfaces of the fixed scroll (21) and the movable scroll (22) in contact with each other and high-pressure oil introducing means (46) for introducing a high-pressure oil in the casing (10) into the oil groove (43) when the compression ratio exceeds the predetermined value.

2. The scroll type compressor of claim 1, wherein the high-pressure space (S2) is a high-pressure oil working space into which the high-pressure oil is supplied, and the high-pressure oil introducing means (46) is arranged to guide the high-pressure oil in the high-pressure oil working space (S2) into the oil groove (43) when the compression ratio exceeds the predetermined value.

3. The scroll type compressor of claim 2, wherein the high-pressure oil introducing means (46) comprises a high-pressure oil introduction passage (44) communicating from the high-pressure oil working space (S2) to the oil groove (43) and a high-pressure oil introduction valve (45) for opening/closing the high-pressure oil introduction passage (44).

4. The scroll type compressor of claim 3, wherein the high-pressure oil introduction valve (45) is arranged to open the high-pressure oil introduction passage (44) upon excess of the compression ratio over the predetermined value while closing the high-pressure oil introduction passage (44) at the compression ratio equal to or less than the predetermined value.

5. The scroll type compressor of claim 4, wherein the high-pressure oil introduction valve (45) comprises a cylinder (47) disposed to traverse the way of the high-pressure oil introduction passage (44) and a piston-like valve body (48) provided for reciprocation movement in the cylinder (47), and the valve body (48) is arranged to move to an open position at which the high-pressure oil introduction passage (44) is opened upon excess of the compression ratio over the predetermined value while moving to a closed position at which the high-pressure oil introduction passage (44) is closed at the compression ratio equal to or less than the predetermined value.

6. The scroll type compressor of claim 5, wherein the cylinder (47) of the high-pressure oil introduction valve (45) communicates at one end thereof with a low-pressure space (S1) provided in the casing (10) and communicates at the other end with a high-pressure space (S3) in the casing (10), urging means (50) is provided for urging the valve body (48) toward the closed position in the cylinder (47), and an urging force of the urging means (50) is set in accordance with a predetermined pressure differential between the low-pressure space (S1) and the high-pressure space (S3) so that the urging means (50) holds the valve body (48) at the closed position when the compression ratio is equal to or less than the predetermined value and allows movement of the valve body (48) to the open position when the compression ratio exceeds the predetermined value.

7. The scroll type compressor of claim 6, wherein the valve body (48) comprises a communication passage (48*a*) to block the high-pressure oil introduction passage (44) at its closed position while opening the high-pressure oil introduction passage (44) through the communication passage (48*a*) at its open position.

8. The scroll type compressor of claim 7, wherein the communication passage (48*a*) of the valve body (48) comprises a circumferential channel formed in an outer peripheral surface of the valve body (48).

9. The scroll type compressor of claim 6, wherein a frame (23) for separating the low-pressure space (S1) and the high-pressure space (S3) is disposed in the casing (10) below the movable scroll (22), a sealing member (42) is provided for dividing a space located between the frame (23) and the movable scroll (22) into the low-pressure space (S1) and the high-pressure oil working space (S2), and the frame (23) is provided with the high-pressure oil introduction passage (44) and the high-pressure oil introduction valve (45).

10. A scroll type compressor comprising: a fixed scroll (21) fixed inside of a casing (10); a movable scroll (22) meshed with the fixed scroll (21); and pressing means (40) for pressing the movable scroll (22) against the fixed scroll (21), said pressing means (40) being arranged so as to have a high-pressure space (S2) that serves a back face side of the movable scroll (22) and to always suppress a pressing force of the movable scroll (22) against the fixed scroll (21) through the high-pressure space (S2) in association with variation in compression ratio, said pressing means (40) comprising an oil groove (43) formed between contact surfaces of the fixed scroll (21) and the movable scroll (22) in contact with each other and a high-pressure oil introduction passage (44) for always introducing a high-pressure oil in the casing (10) into the oil groove (43).

11. The scroll type compressor of claim 10, wherein the high-pressure space (S2) is a high-pressure oil working space into which the high-pressure oil is supplied, and the high-pressure oil introduction passage (44) is arranged to communicate from the high-pressure oil working space (S2) to the oil groove (43) and always guide the high-pressure oil in the high-pressure oil working space (S2) to the oil groove (43).

12. The scroll type compressor of claim 11, further comprising:

a frame (23) for dividing an inner space of the casing (10) into a low-pressure space (S1) and a high-pressure space (S3), the frame (23) being disposed below the movable scroll (22); and a sealing member (42) for dividing a space between the frame (23) and the movable scroll (22) into the low-pressure space (S1) and the high-pressure oil working space (S2), the frame (23) being provided with the high-pressure oil introduction passage (44).

13. The scroll type compressor of claim 3 or 10, wherein the high-pressure oil introduction passage (44) is provided with a restriction section (44*b*).

14. The scroll type compressor of claim 13, wherein the restriction section (44*b*) comprises a reduced-diameter part provided at least partially in the high-pressure oil introduction passage (44).

15. The scroll type compressor of claim 13, wherein the restriction section (44*b*) comprises a capillary tube (44*e*) provided at least partially in the high-pressure oil introduction passage (44).

16. The scroll type compressor of claim 13, wherein the restriction section (44*b*) is formed so that a bar-like member (44*f*) narrower in diameter than the high-pressure oil introduction passage (44) is placed at least partially in the high-pressure oil introduction passage (44) to form a clearance with the high-pressure oil introduction passage (44).

* * * * *